US011855397B1

(12) United States Patent
Lynch

(10) Patent No.: US 11,855,397 B1
(45) Date of Patent: Dec. 26, 2023

(54) STAND WITH MOVABLE CONNECTOR INTERFACE FOR PORTABLE ELECTRONIC DEVICE

(71) Applicant: Pioneer Square Brands, Inc., Seattle, WA (US)

(72) Inventor: Riley Edwin Lynch, Greensboro, NC (US)

(73) Assignee: Pioneer Square Brands, Inc., High Point, NC (US)

( * ) Notice: Subject to any disclaimer, the term of this patent is extended or adjusted under 35 U.S.C. 154(b) by 0 days.

(21) Appl. No.: 18/224,484

(22) Filed: Jul. 20, 2023

(51) Int. Cl.

| | |
|---|---|
| ***H01R 33/94*** | (2006.01) |
| ***H01R 13/24*** | (2006.01) |
| ***A45C 11/00*** | (2006.01) |
| ***H01R 12/91*** | (2011.01) |

(52) U.S. Cl.
CPC ..... *H01R 33/94* (2013.01); *A45C 11/00* (2013.01); *H01R 12/91* (2013.01); *H01R 13/24* (2013.01); *A45C 2011/003* (2013.01); *A45C 2200/15* (2013.01)

(58) Field of Classification Search
CPC ..... H01R 33/94; H01R 13/24; A45C 11/00; A45C 2011/003; A45C 2200/15
See application file for complete search history.

(56) References Cited

U.S. PATENT DOCUMENTS

| | | | | |
|---|---|---|---|---|
| 7,166,987 | B2 * | 1/2007 | Lee | H02J 7/0013 206/703 |
| 8,113,873 | B1 * | 2/2012 | Sarraf | H01R 13/6315 439/533 |
| 9,502,817 | B2 * | 11/2016 | Kim | H01R 13/6205 |
| 9,531,118 | B2 * | 12/2016 | Byrne | H01R 13/2421 |
| 9,706,026 | B2 * | 7/2017 | Carnevali | H01R 31/06 |
| 9,742,107 | B2 * | 8/2017 | Choi | H01R 13/6315 |
| 10,027,149 | B2 * | 7/2018 | Warren | H01R 33/945 |
| 11,769,976 | B1 * | 9/2023 | Lakic | H01R 13/518 439/39 |
| 2004/0014349 | A1 * | 1/2004 | Oddsen, Jr. | H01R 13/625 439/345 |
| 2013/0005179 | A1 * | 1/2013 | Aldana | G06F 1/1632 439/529 |
| 2016/0087381 | A1 * | 3/2016 | Wong | H01R 27/02 439/529 |

* cited by examiner

*Primary Examiner* — Travis S Chambers
(74) *Attorney, Agent, or Firm* — Grandview Law

(57) ABSTRACT

Systems involve implementations such as a stand assembly including a base having an exterior face; a wall portion including an exterior face, the wall portion coupled to the base, the exterior face of the wall portion extending perpendicular with respect to the exterior face of the base; a support assembly including a first elongated portion extending perpendicular with respect to the wall portion; and an interface including a plurality of electrical contacts, wherein the interface is movably coupled having at least a first position and a second position. Other aspects are described in the claims, drawings, and text forming a part of the present disclosure.

17 Claims, 38 Drawing Sheets

STAND WITH MOVABLE CONNECTOR INTERFACE FOR PORTABLE ELECTRONIC DEVICE

SUMMARY

In one or more aspects a system for a portable electronic computing device including a stand assembly including (I) a base having an exterior face; (II) a wall portion including an exterior face, the wall portion coupled to the base, the exterior face of the wall portion extending perpendicular with respect to the exterior face of the base; (III) a support assembly including a first elongated portion extending perpendicular with respect to the exterior face of the wall portion; and (IV) an interface including a plurality of electrical contacts, wherein the interface is movably coupled having at least a first position and a second position. Wherein the plurality of electrical contacts includes at least one pogo pin. Wherein the interface is movably coupled to the wall portion. Wherein the plurality of electrical contacts of the interface includes at least one row of electrical contacts positioned along a first direction, and wherein the interface is movably coupled to the wall portion to move in a second direction perpendicular to the first direction. Wherein the support assembly further includes a second elongated portion extending perpendicular with respect to the exterior face of the wall portion, wherein the base includes two sides with the exterior face of the base extending a first width therebetween, and wherein the first elongated portion and the second elongated portion of the support assembly are spaced from one another with a gap therebetween at least one half of the first width of the exterior face of the base. Wherein the support assembly further includes a first elongated protrusion extending perpendicularly from the first elongated portion and a second elongated protrusion extending perpendicularly from the second elongated portion, wherein the wall portion includes a first elongated aperture and a second elongated aperture, wherein the support assembly is couplable with the wall portion with the first elongated protrusion being at least partially coupled with the first elongated aperture and the second elongated protrusion being at least partially coupled with the second elongated aperture, wherein the first elongated protrusion is spaced a first distance from the exterior face of the base and the second elongated protrusion is spaced a second distance from the exterior face of the base, and wherein the first distance is greater than the second distance. Wherein the support assembly further includes a third elongated portion extending perpendicular to and therebetween the first elongated portion and the second elongated portion, wherein the base includes an end with the exterior face of the base extending a first length between the end and the wall portion, and wherein the third elongated portion of the support assembly is spaced from the exterior face of the wall portion at least one half of the first length the exterior face of the base. Wherein the wall portion has a first side, a second side, and an end extending therebetween, wherein the end is perpendicularly oriented with the exterior face of the wall portion, wherein the end includes a protrusion extending over the exterior surface of the base when the wall portion is coupled with the base. Wherein the wall portion includes an aperture, wherein the interface is movably coupled to the wall portion, and wherein a portion of the interface protrudes through the aperture of the wall portion when the interface is movably coupled to the wall portion. Further including a coupler assembly, wherein the coupler assembly includes a slab member with an aperture, wherein the coupler assembly is couplable with the interface, wherein the coupler assembly is couplable to the wall portion, and wherein at least a portion of the interface protrudes through the aperture of the slab member of the coupler assembly when the interface is coupled to the coupler assembly and the coupler assembly is coupled to the wall portion. Wherein the coupler assembly includes at least one collar portion positioned adjacent to the aperture of the coupler assembly, and wherein the interface is coupled with the at least one collar portion when the interface is coupled with the coupler assembly. Wherein the wall portion includes at least one elongated protrusion, wherein the slab member of the coupler assembly includes at least one groove, and wherein the at least one groove of the slab member is slidably coupled with the at least one elongated protrusion of the wall portion when the coupler assembly is coupled with the wall portion. Wherein the coupler assembly includes at least one plate member, and wherein the slab member of the coupler assembly is positioned between the at least one plate member and the wall portion when the coupler assembly is coupled to the wall portion. Wherein the electrical cabling is electrically coupled with the interface.

In one or more aspects a system for a portable electronic computing device including a stand assembly including (I) a base having an exterior face; (II) a wall portion including an exterior face and an aperture through the exterior face, the wall portion coupled to the base, the exterior face of the wall portion extending perpendicular with respect to the exterior face of the base; (III) a support assembly including a first elongated portion extending perpendicular with respect to the wall portion; and (IV) an interface including a plurality of electrical contacts, wherein the interface is movably coupled to the wall portion, the interface being accessible through the aperture of the wall portion. Wherein the plurality of electrical contacts of the interface includes at least one row of electrical contacts positioned along a first direction, and wherein the interface is movably coupled to the wall potion to move in a second direction perpendicular to the first direction. Further including a coupler assembly, wherein the coupler assembly includes a slab member with an aperture, wherein the coupler assembly is couplable with the interface, wherein the coupler assembly is couplable to the wall portion, wherein at least a portion of the interface protrudes through the aperture of the slab member of the coupler assembly when the interface is coupled to the coupler assembly and the coupler assembly is coupled to the wall portion, wherein the coupler assembly includes at least one plate member, and wherein the slab member of the coupler assembly is positioned between the at least one plate member and the wall portion when the coupler assembly is coupled to the wall portion.

In one or more aspects a system for a portable electronic computing device including a stand assembly including (I) a base having an exterior face; (II) a wall portion including an exterior face and an aperture through the exterior face, the wall portion coupled to the base, the exterior face of the wall portion extending perpendicular with respect to the exterior face of the base; (III) a support assembly including a first elongated portion extending perpendicular with respect to the wall portion; and (IV) an interface including a plurality of electrical contacts, wherein the interface is movably coupled to the wall portion, wherein the interface is accessible through the aperture of the wall portion when the interface is movably coupled to the wall portion, wherein the plurality of electrical contacts of the interface includes at least one row of electrical contacts positioned along a first direction, and wherein the interface is movably coupled to the wall portion to move in a second direction perpendicular to the first direction. Further including a coupler assembly, wherein the coupler assembly includes a slab member with an aperture, wherein the coupler assembly is couplable with the interface, wherein the coupler assembly is couplable to the wall portion, and wherein at least a portion of the interface protrudes through the aperture of the slab member of the coupler assembly when the interface is coupled to the coupler assembly and the coupler assembly is coupled to the wall portion. Wherein the wall portion includes at least one elongated protrusion, wherein the slab member of the coupler assembly includes at least one groove, and wherein the at least one groove of the slab member is slidably coupled with the at least one elongated protrusion o the wall portion when the coupler assembly is coupled with the wall portion.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of Stand System for Portable Electronic Device, articles of manufacture, compositions of matter for same that may provide context, for instance, in introducing one or more processes and/or devices described herein.

DETAILED DESCRIPTION

Figure 1:
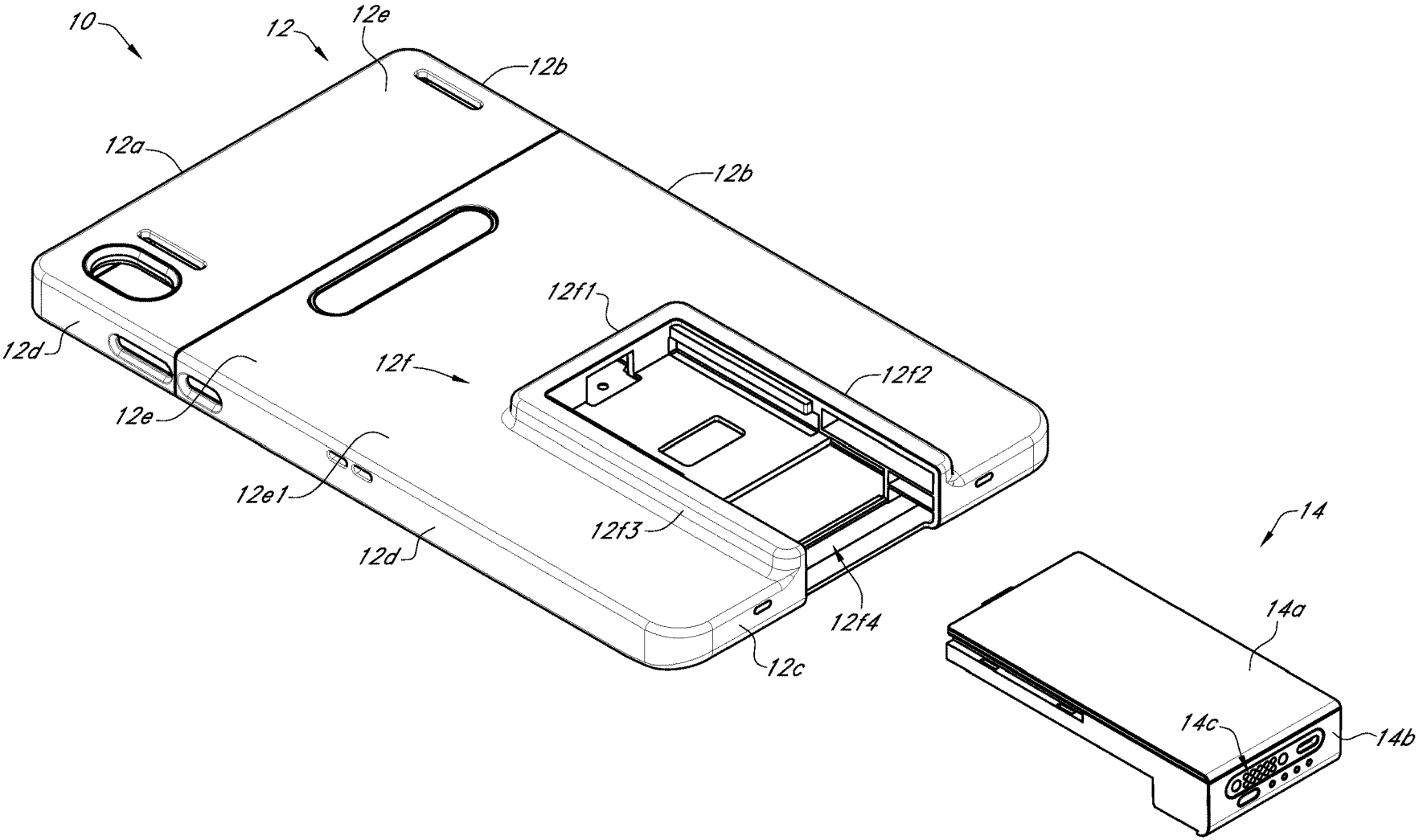
FIG. 1 is a rear-bottom perspective view of an accessory assembly uncoupled from a case assembly.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a rear-bottom perspective view of combination assembly system 10 including accessory assembly 14 uncoupled from case assembly 12.

Depicted implementation of case assembly 12, for containing a conventional portable electronic device (not shown), is shown to include side 12*a*, side 12*b*, side 12*c*, side 12*d*, base 12*e*, and raised base portion 12*f*. Depicted implementation of base 12*e* is shown to include exterior face 12*e*1. Depicted implementation of raised base portion 12*f* is shown to include side 12*f*1, side 12*f*2, side 12*f*3, and opening 12*f*4, which accommodates coupling of case assembly 12 with accessory assembly 14, which provides power, communication, or other functional support to a conventional portable electronic device (not shown). Depicted implementation of accessory assembly 14 is shown to include exterior face 14*a*, side 14*b*, and interface 14*c*.

Figure 2:
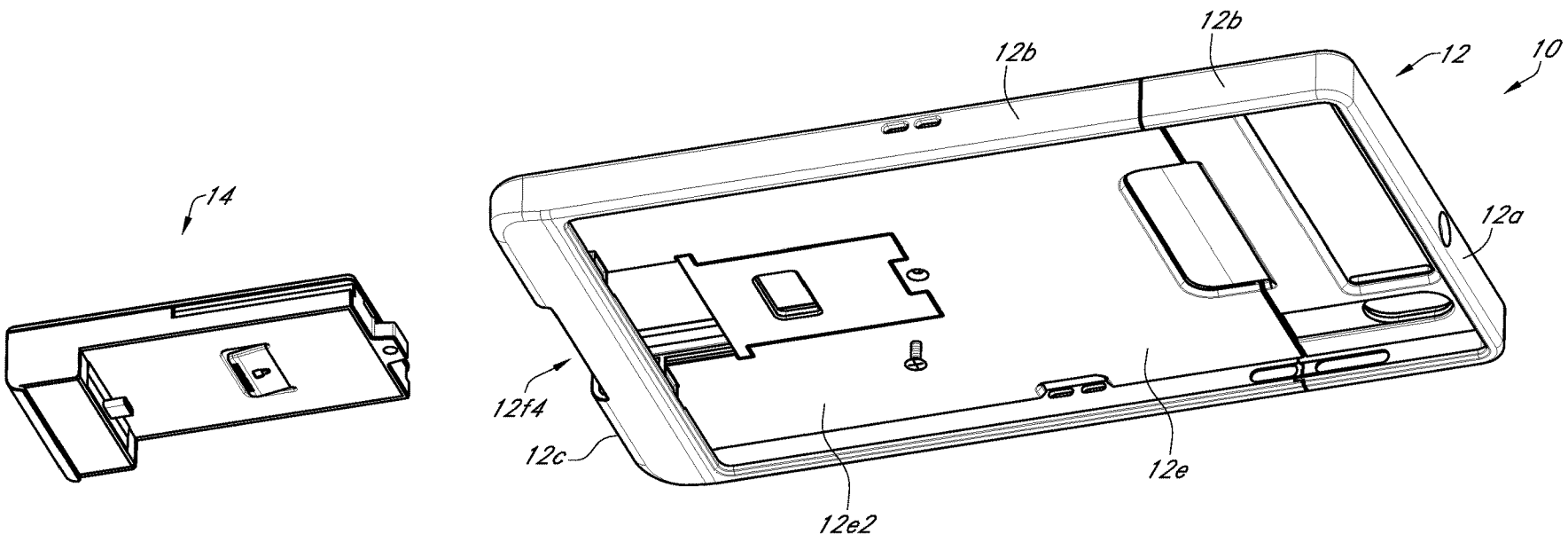
FIG. 2 is a front-top perspective view of the accessory assembly uncoupled from the case assembly of FIG. 1.

Turning to FIG. 2, depicted therein is a front-top perspective view of accessory assembly 14 uncoupled from case assembly 12. Depicted implementation of base 12*e* is shown to include interior 12*e*2.

Figure 3:
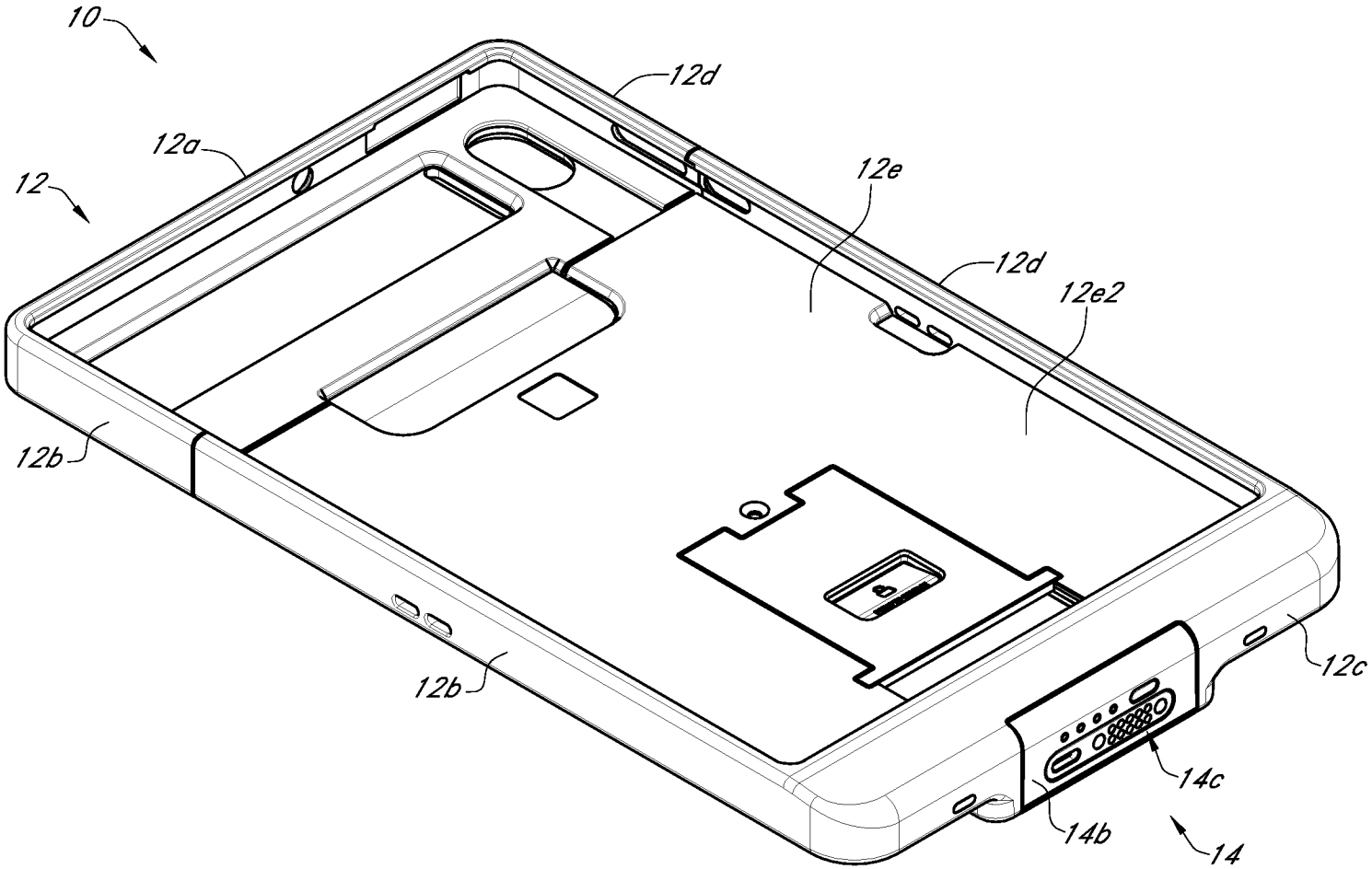
FIG. 3 is a rear-top-perspective view of the case assembly coupled with the accessory assembly of FIG. 1.

Turning to FIG. 3, depicted therein is a rear-top-perspective view of accessory assembly 14 coupled with case assembly 12.

Figure 4:
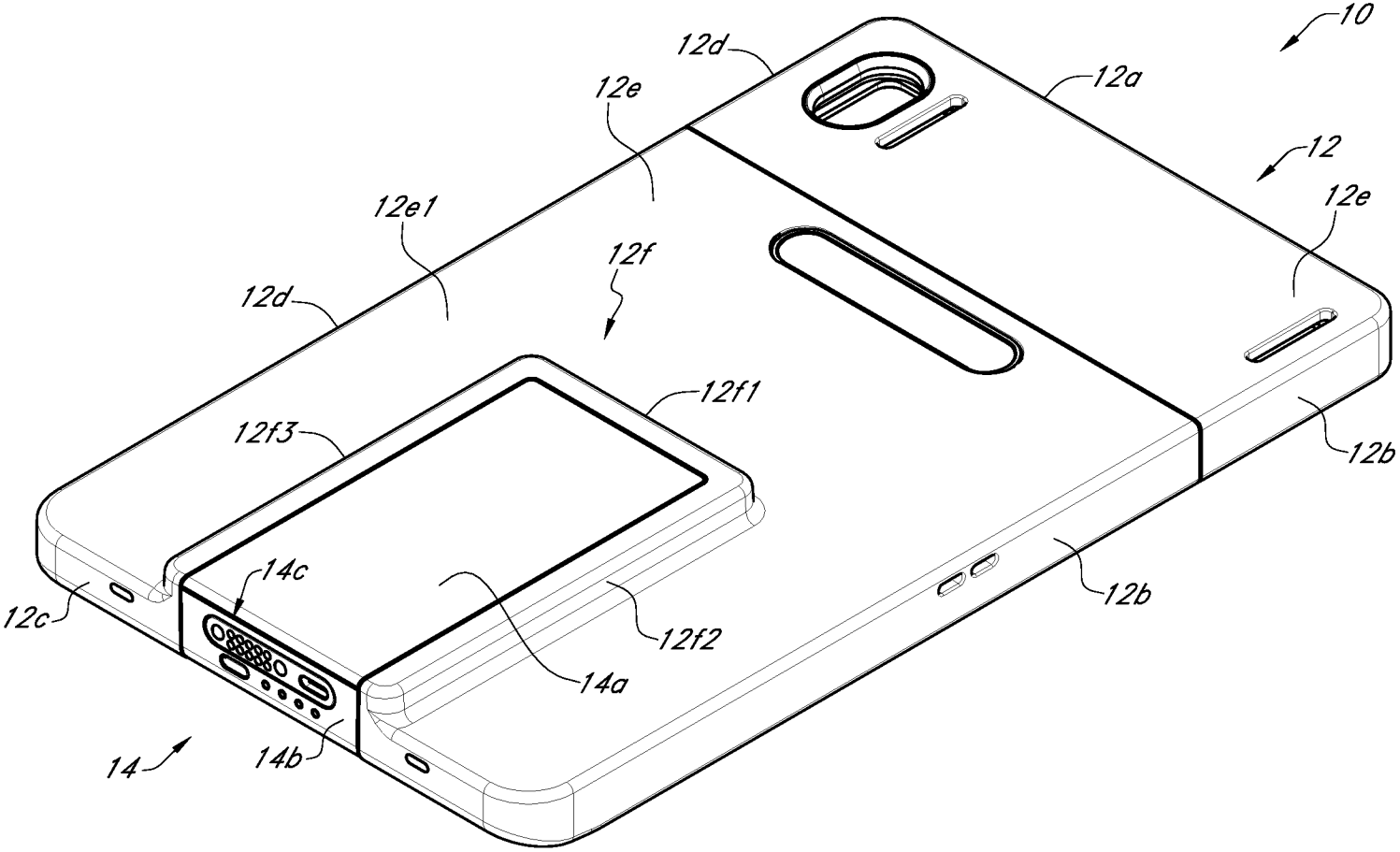
FIG. 4 is a rear-bottom-perspective view of the case assembly coupled with the accessory assembly of FIG. 1.

Turning to FIG. 4, depicted therein is a rear-bottom-perspective view of accessory assembly 14 coupled with case assembly 12.

Figure 5:
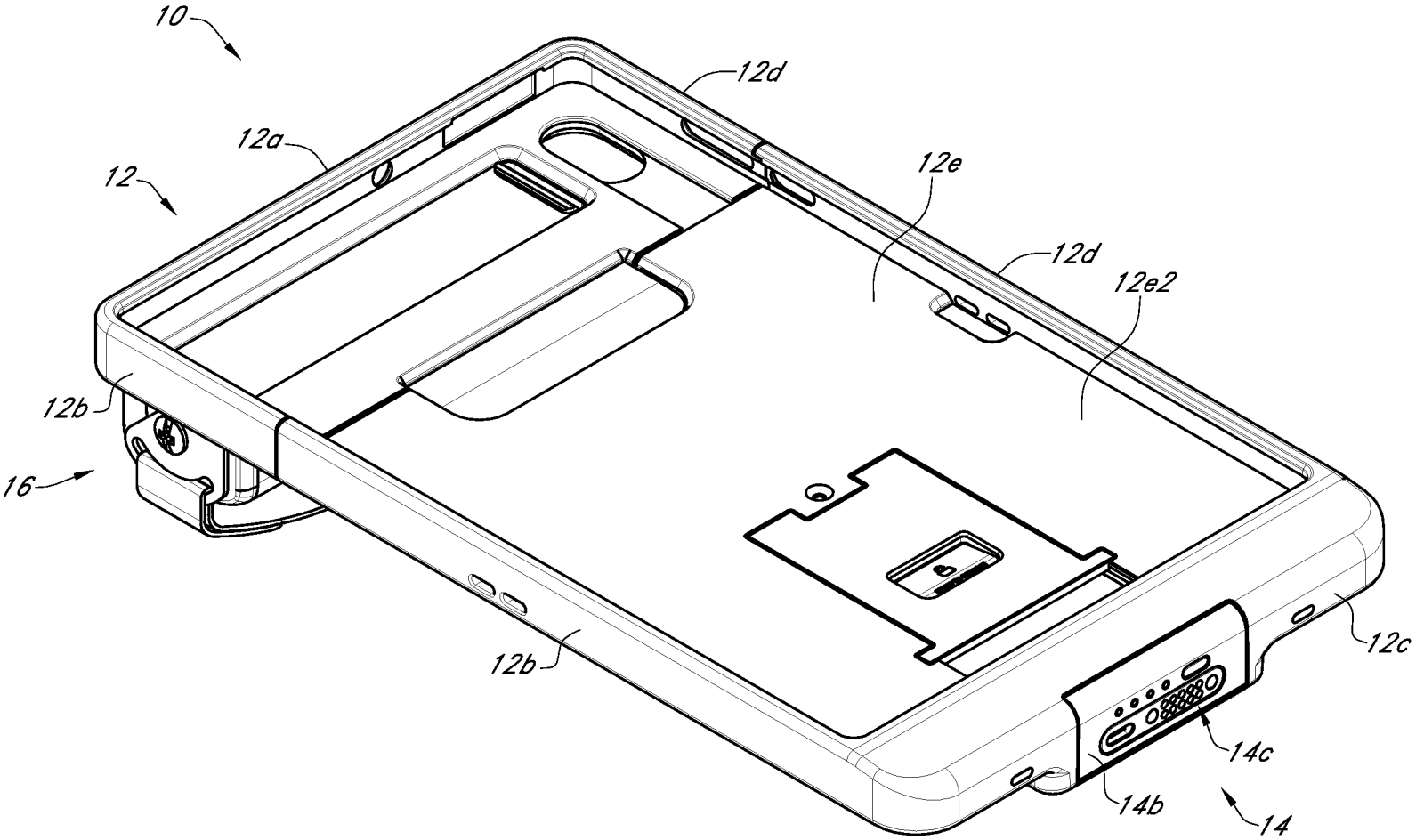
FIG. 5 is a rear-top-perspective view of the case assembly coupled with the accessory assembly of FIG. 1 and coupled with a handle assembly.

Turning to FIG. 5, depicted therein is a rear-top-perspective view of combination assembly system 10 with accessory assembly 14 coupled with case assembly 12 and coupled with handle 16.

Figure 6:
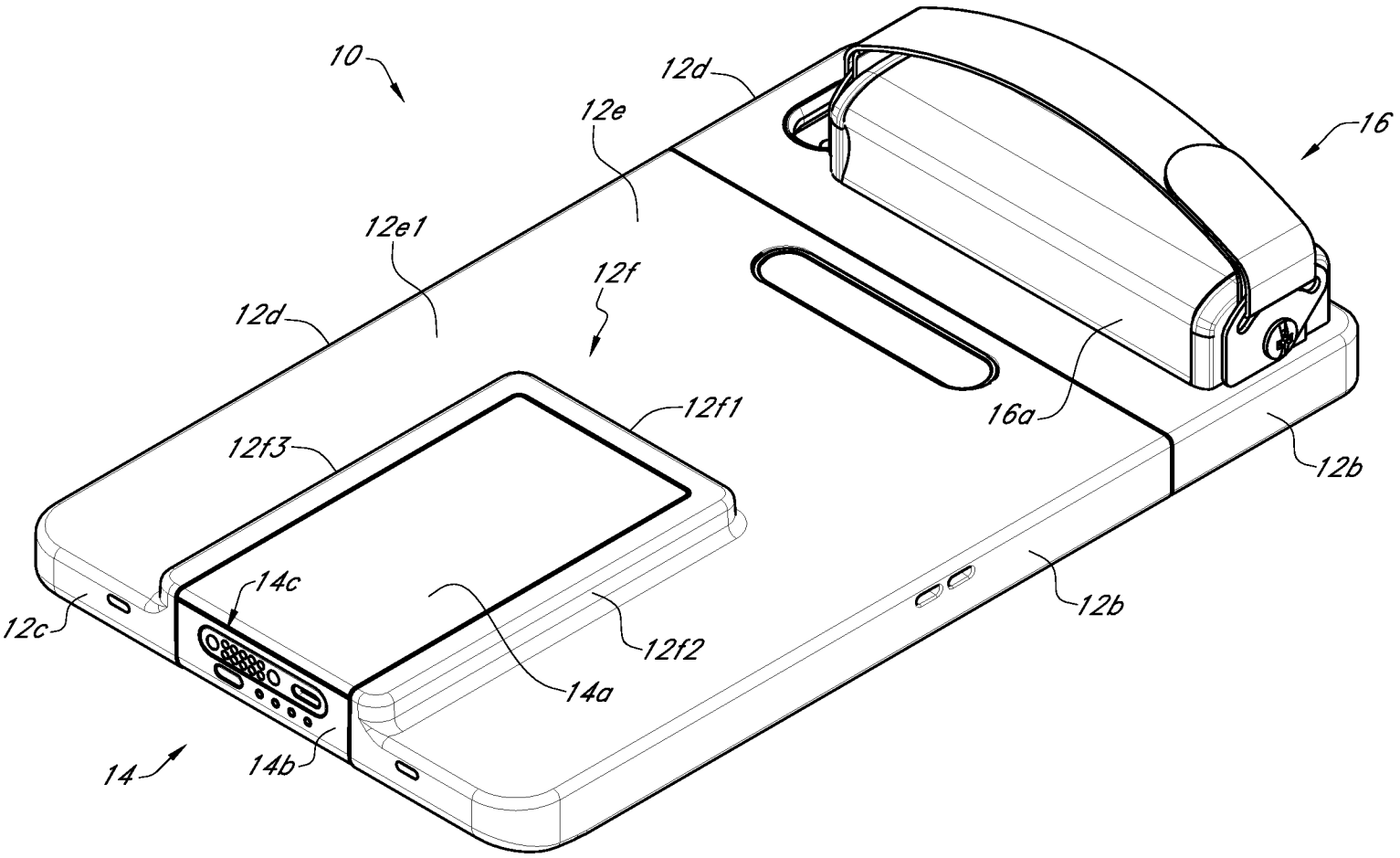
FIG. 6 is a rear-bottom-perspective view of the case assembly coupled with the accessory assembly of FIG. 1 and coupled with the handle assembly of FIG. 5.

Turning to FIG. 6, depicted therein is a rear-bottom-perspective view of case assembly 12 coupled with accessory assembly 14 and coupled with handle 16. Depicted implementation of handle 16 is shown to include side 16*a*.

Figure 7:
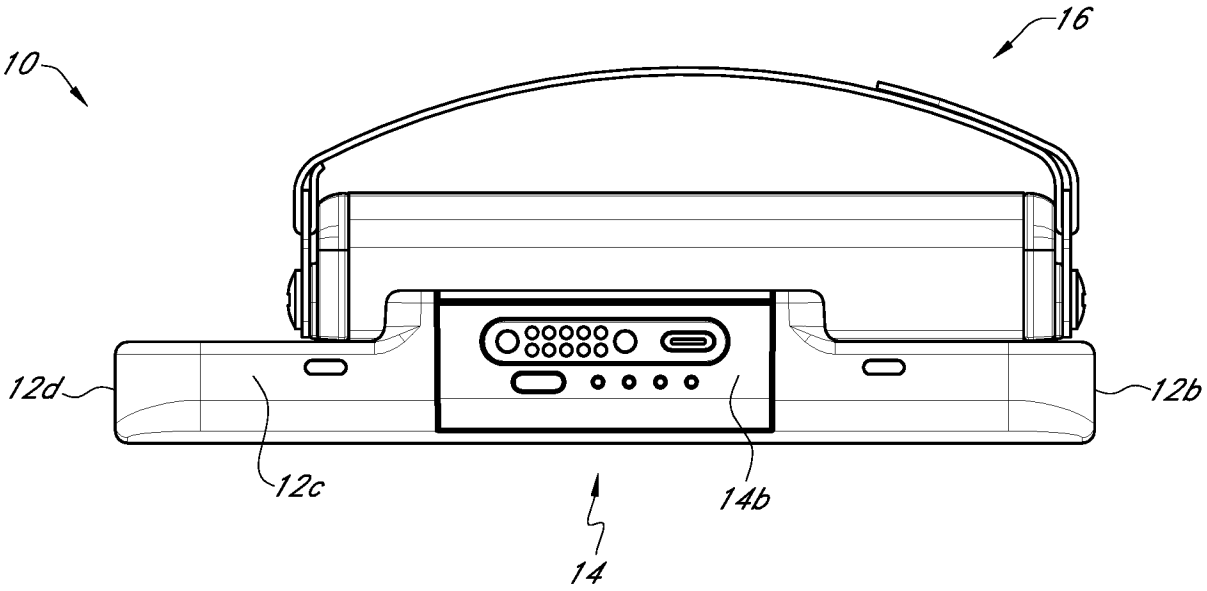
FIG. 7 is a rear-elevational view of the case assembly coupled with the accessory assembly of FIG. 1 and coupled with the handle assembly of FIG. 5.

Turning to FIG. 7, depicted therein is a rear-elevational view of case assembly 12 coupled with the accessory assembly accessory assembly 14 and coupled with handle 16.

Figure 8:
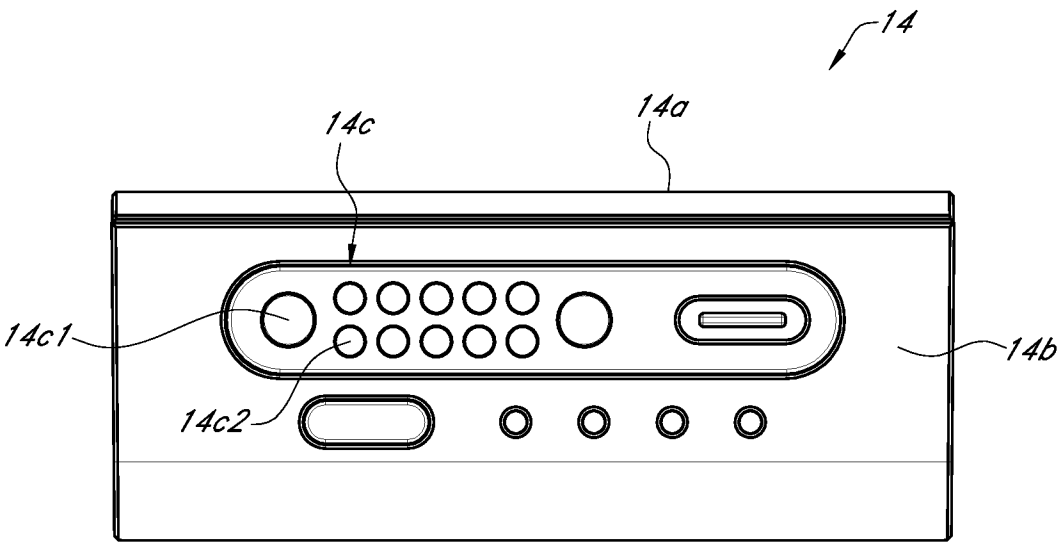
FIG. 8 is a rear-elevational view of the accessory assembly of FIG. 1.

Turning to FIG. 8, depicted therein is a rear-elevational view of accessory assembly 14. Depicted implementation of accessory assembly 14 is shown to include interface 14*c*, which includes electrical contact 14*c*1 and electrical contact 14*c*2.

Figure 9:
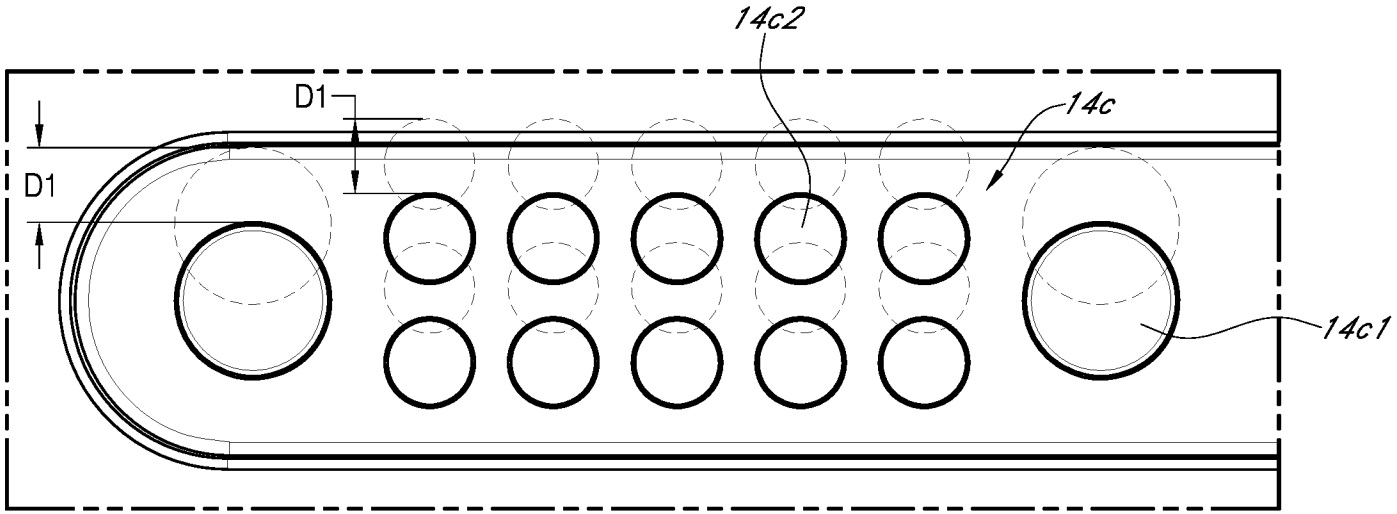
FIG. 9 is a rear-elevational view of an enlarged portion of the accessary assembly of FIG. 8.

Turning to FIG. 9, depicted therein is a rear-elevational view of an enlarged portion of accessory assembly 14 taken along the 9 dashed-line area of FIG. 8. Depicted implementation of interface 14*c* is shown to include variation of variability of positioning of electrical contact 14*c*1 and electrical contact 14*c*2 by dimension D1 depending upon particular manufacturer.

Figure 10:
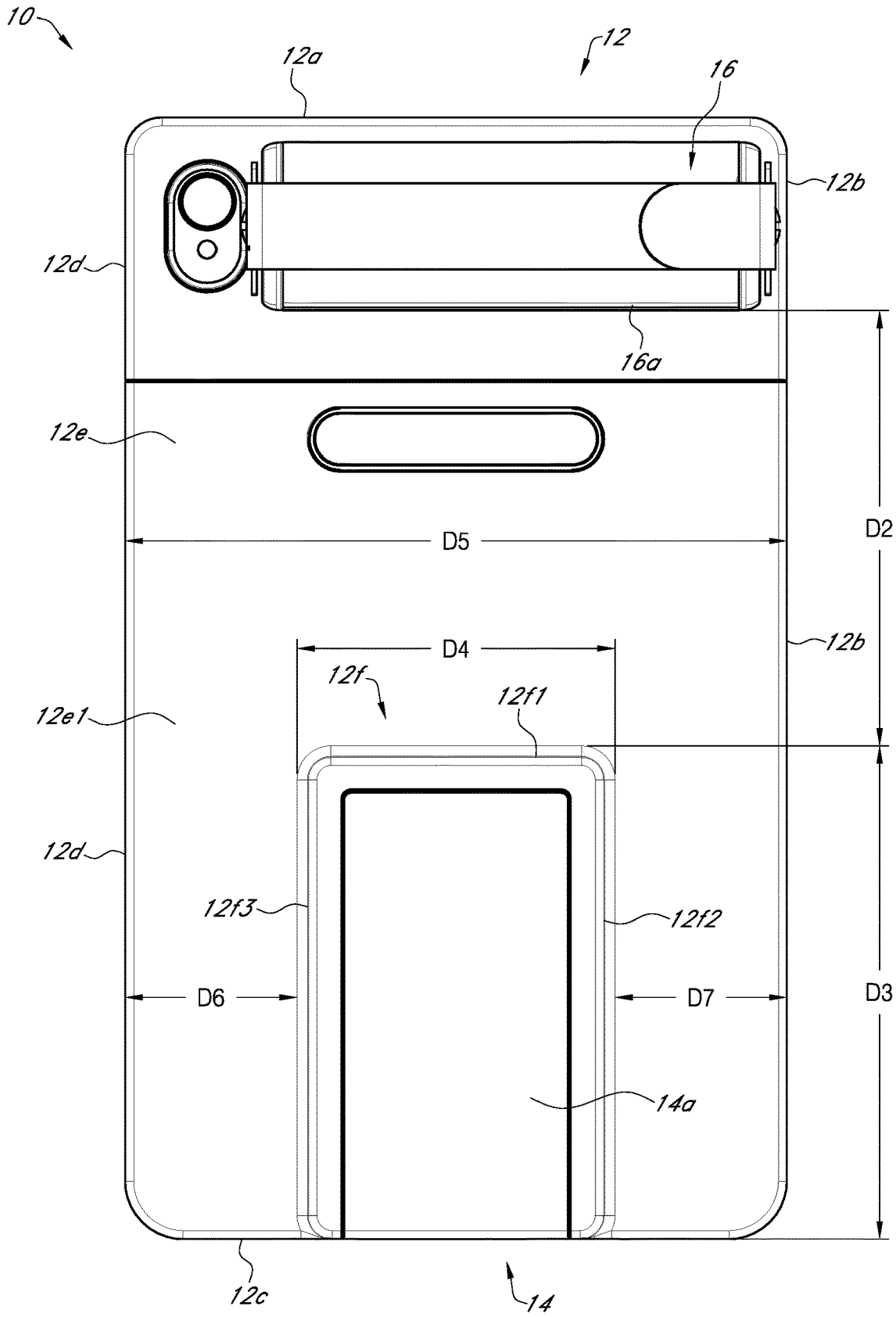
FIG. 10 is a bottom-plan-view of the case assembly coupled with the accessory assembly of FIG. 1 coupled with the handle assembly of FIG. 5.

Turning to FIG. 10, depicted therein is a bottom-plan-view of case assembly 12 coupled with accessory assembly 14 and coupled with handle 16. Depicted implementation of combination assembly system 10 is shown to include dimension D2, dimension D3, dimension D4, dimension D5, dimension D6, and dimension D7.

Figure 11:
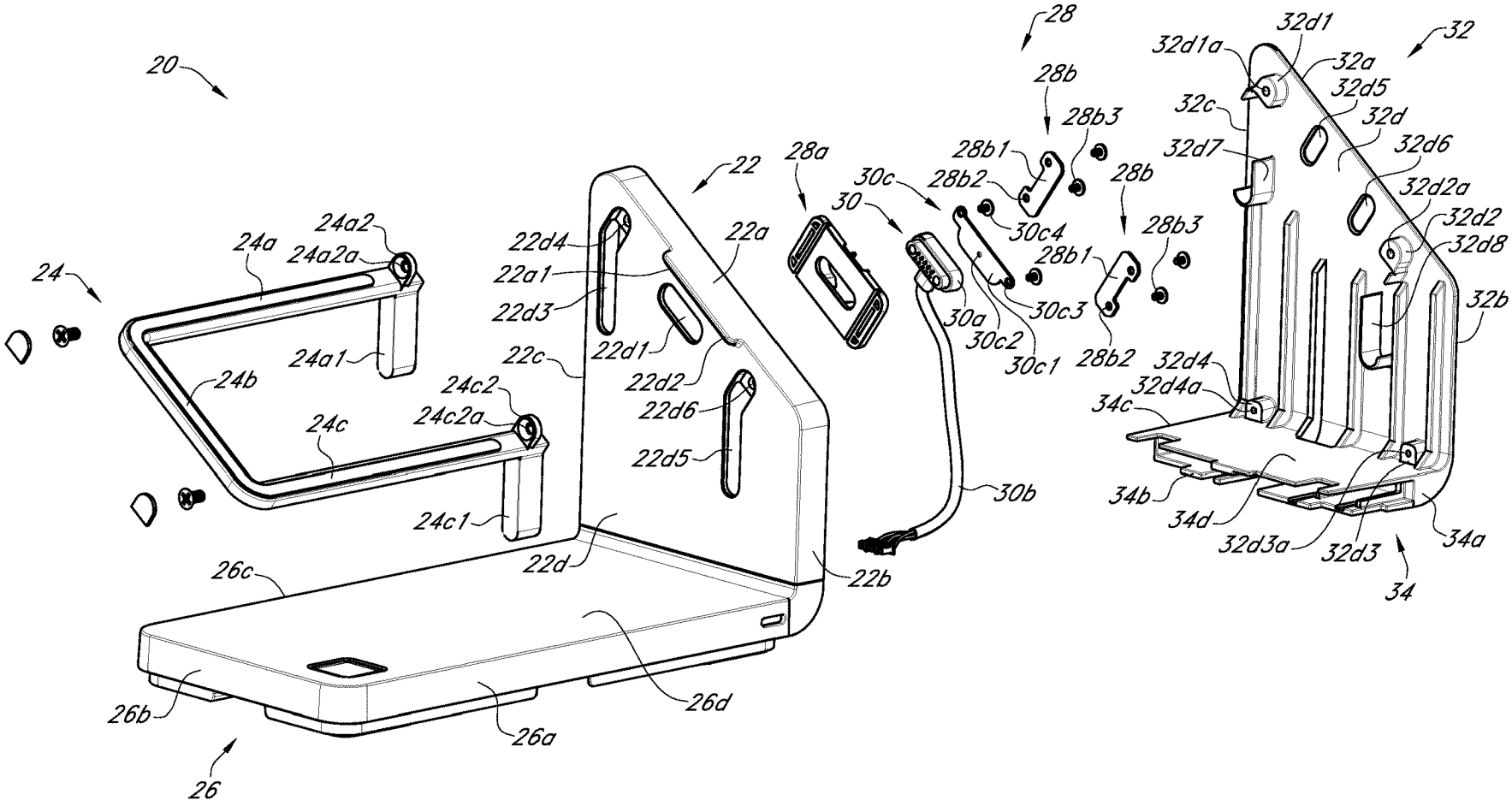
FIG. 11 is a partially exploded top-front perspective view of a stand assembly.

Turning to FIG. 11, depicted therein is a partially exploded top-front perspective view of stand assembly 20. Depicted implementation of stand assembly 20 is shown to include wall portion 22, support assembly 24, and base 26, coupler assembly 28, interface assembly 30, wall portion 32 and engagement portion 34.

Depicted implementation of wall portion 22 is shown to include side 22*a* with protrusion 22*a*1, side 22*b*, and side 22*c*, exterior face 22*d* with aperture 22*d*1, protrusion 22*d*2, aperture 22*d*3, aperture 22*d*4, aperture 22*d*5, and aperture 22*d*6.

Depicted implementation of support assembly 24 is shown to include elongated portion 24*a* with elongated protrusion 24*a*1, protrusion 24*a*2, and aperture 24*a*2*a*, elongated portion 24*b*, and elongated portion 24*c* with elongated protrusion 24*c*1, protrusion 24*c*2, and aperture 24*c*2*a*. As depicted, elongated portion 24*b* extends between elongated portion 24*a* and elongated portion 24*c*. As depicted, support assembly 24 is couplable to wall portion 22 to thereby have elongated portion 24*a* and elongated portion 24*c* of support assembly 24 extend perpendicularly with respect to exterior face 22*d* of wall portion 22.

Depicted implementation of base 26 is shown to include side 26*a*, end 26*b*, side 26*c*, and exterior face 26*d*. Furthermore, wall portion 22 is couplable to base 26. As depicted aperture 22*d*3 is spaced from exterior face 26*d* a farther distance than aperture 22*d*5 is spaced from exterior face 26*d*. As depicted protrusion 22*a*1 extends over exterior face 26*d* when wall portion 22 is coupled with base 26.

Depicted implementation of coupler assembly 28 is shown to include slab member 28*a* and plate member 28*b* with contact face 28*b*1, aperture 28*b*2, and fastener 28*b*3.

Depicted implementation of interface assembly 30 is shown to include interface 30*a*, cabling 30*b*, and plate member 30*c* with plate 30*c*1, aperture 30*c*2, aperture 30*c*3, and fastener 30*c*4.

Depicted implementation of wall portion 32 is shown to include side 32*a*, side 32*b*, side 32*c*, interior face 32*d*. Depicted implementation of interior face 32*d* is shown to include protrusion 32*d*1 with aperture 32*d*1*a*, protrusion 32*d*2 with aperture 32*d*2*a*, protrusion 32*d*3 with aperture 32*d*3*a*, protrusion 32*d*4 with aperture 32*d*4*a*. aperture 32*d*5, aperture 32*d*6, curvilinear protrusion 32*d*7, and curvilinear protrusion 32*d*8.

Depicted implementation of engagement portion 34 is shown to include side 34*a*, side 34*b*, side 34*c*, and interior face 34*d*.

Figure 12:
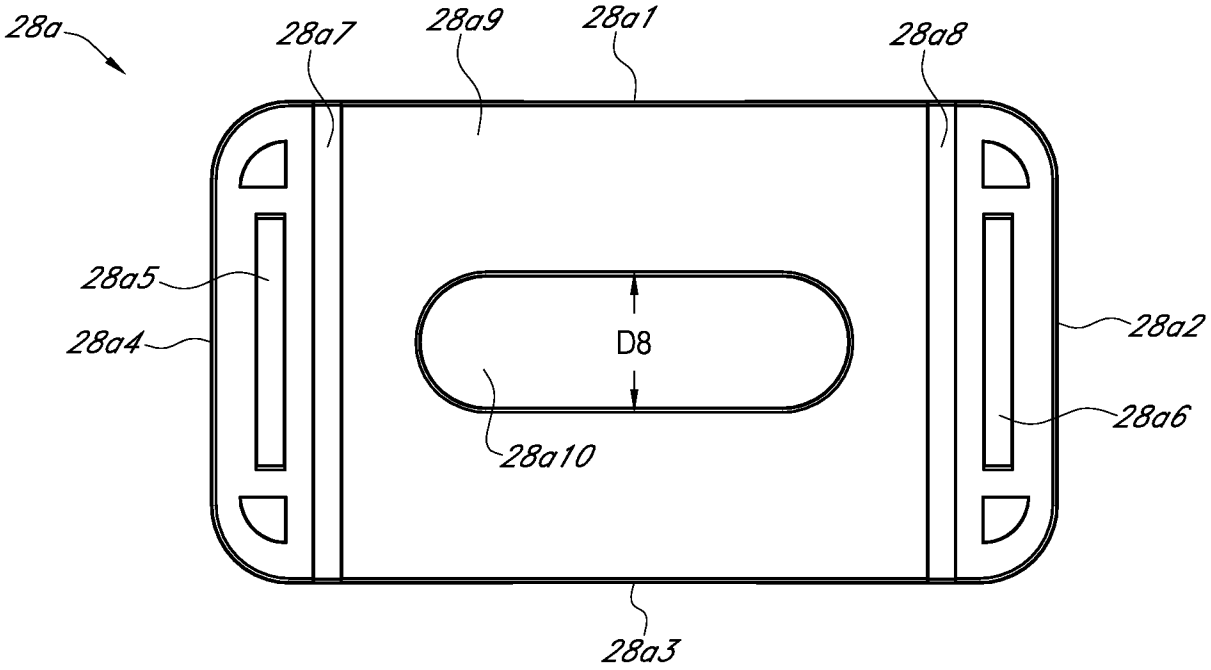
FIG. 12 is a front elevational view of a interface receiver.

Turning to FIG. 12, depicted therein is a front elevational view of slab member 28*a*. Depicted implementation of slab member 28*a* is shown to include side 28*a*1, side 28*a*2, side 28*a*3, side 28*a*4, groove 28*a*5, groove 28*a*6, groove 28*a*7, groove 28*a*8, front face 28*a*9, aperture 28*a*10, and dimension D8.

Figure 13:
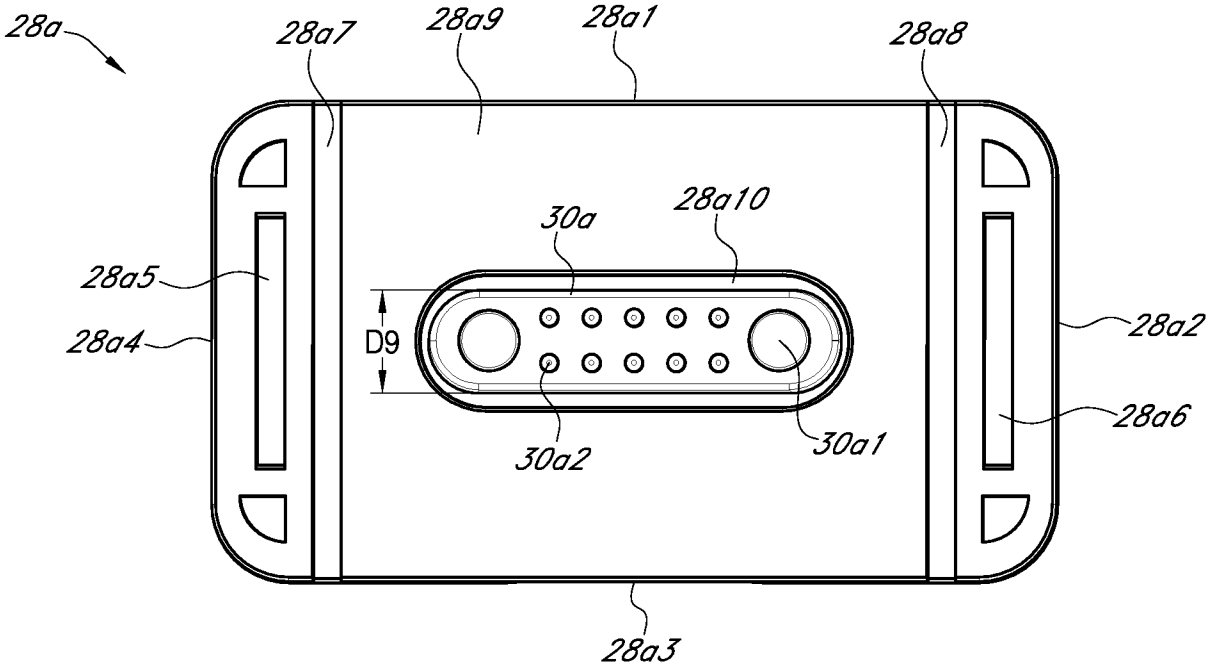
FIG. 13 is a front elevational view of an interface coupled with the interface receiver of FIG. 12.

Turning to FIG. 13, depicted therein is a front elevational view of slab member 28*a* coupled with interface 30*a* partially protruding through aperture 28*a*10 of slab member 28*a*. Depicted implementation of interface 30*a* is shown to include a plurality of electrical contacts, which can include for example, electrical contact 30*a*1, electrical contact 30*a*2, and having dimension D9. Electrical contacts can include pogo pins and magnetically-capable pins.

Figure 14:
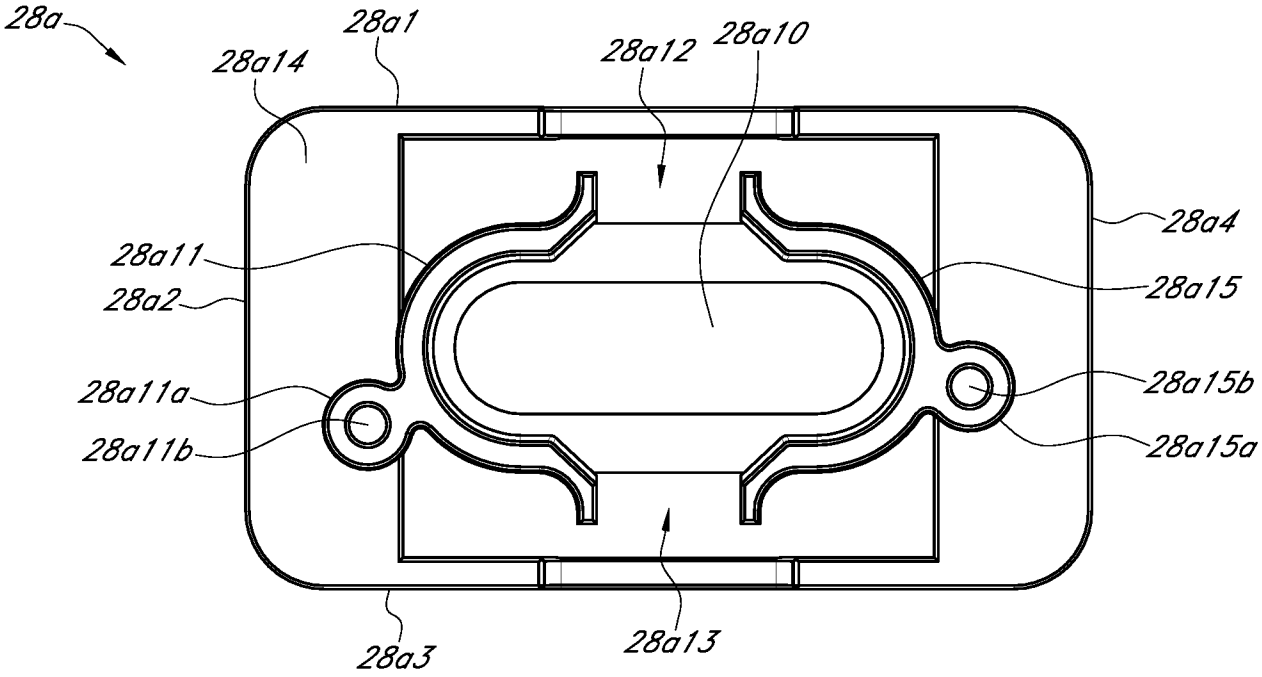
FIG. 14 is a rear elevational view of the interface receiver of FIG. 12.

Turning to FIG. 14, depicted therein is a rear elevational view of slab member 28*a*. Depicted implementation of slab member 28*a* is shown to include collar portion 28*a*11 with protrusion 28*a*1*l* a and aperture 28*a*11*b*, opening 28*a*12, opening 28*a*13, rear face 28*a*14, and collar portion 28*a*15 with protrusion 28*a*15*a* and aperture 28*a*15*b*.

Figure 15:
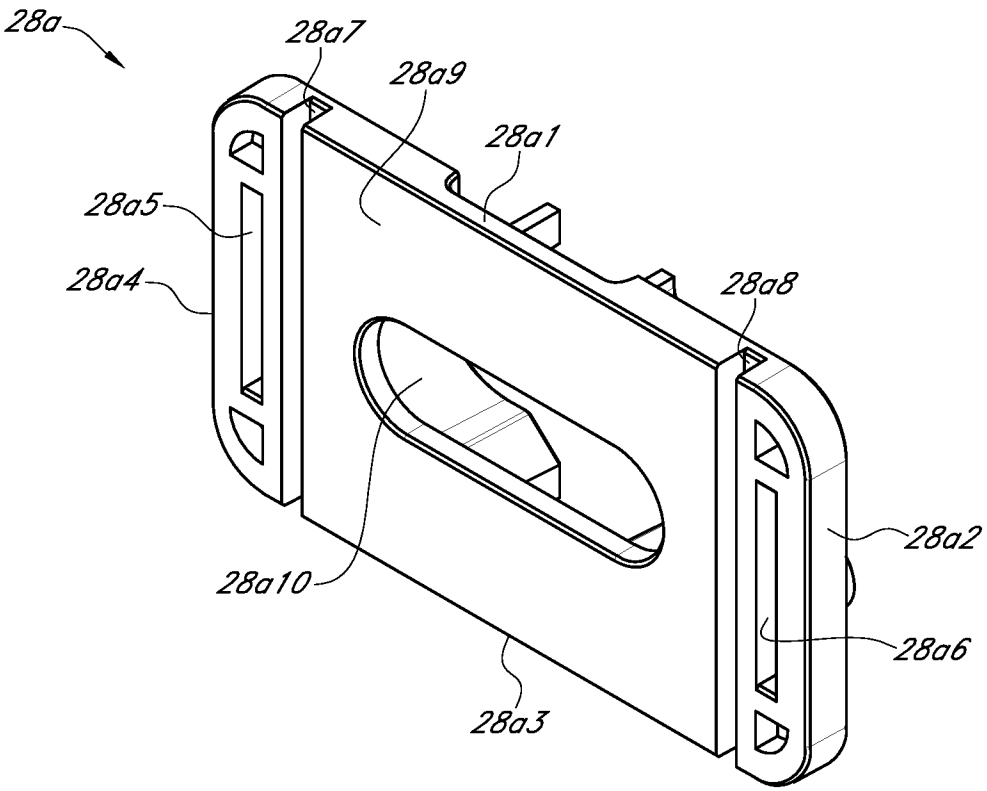
FIG. 15 is a front perspective view of the interface receiver of FIG. 12.

Turning to FIG. 15, depicted therein is a front perspective view of slab member 28*a*.

Figure 16:
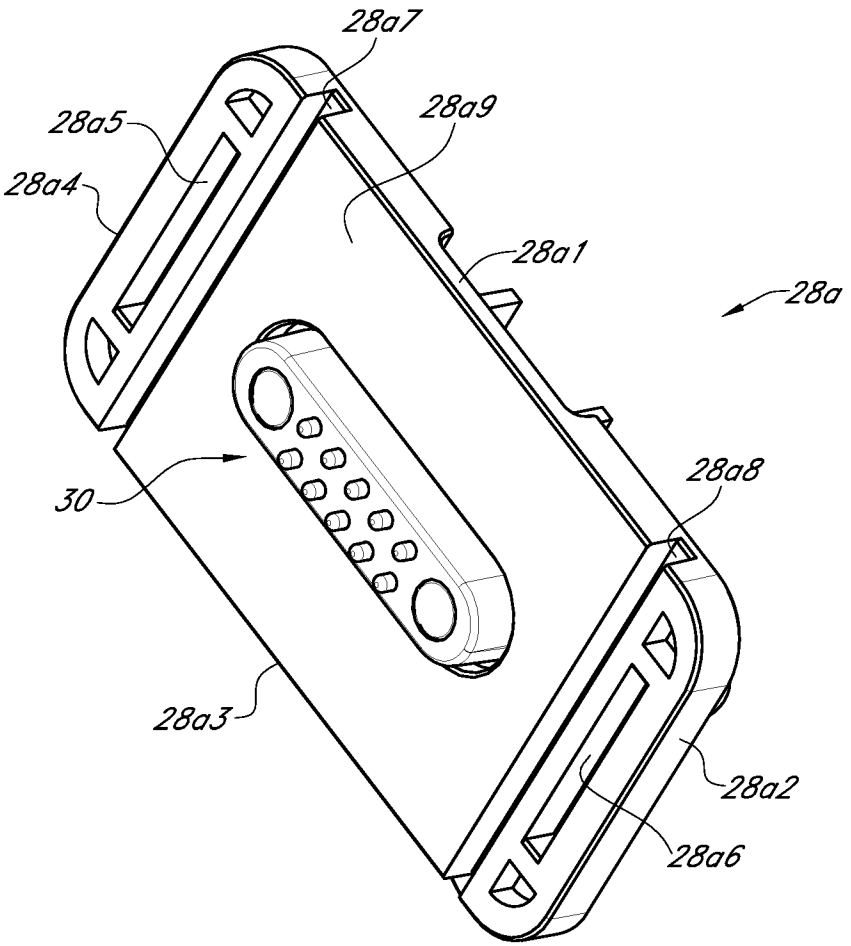
FIG. 16 is a front perspective view of the interface receiver of FIG. 12 coupled with the interface of FIG. 13.

Turning to FIG. 16, depicted therein is a front perspective view of slab member 28*a* coupled with interface 30*a*.

Figure 17:
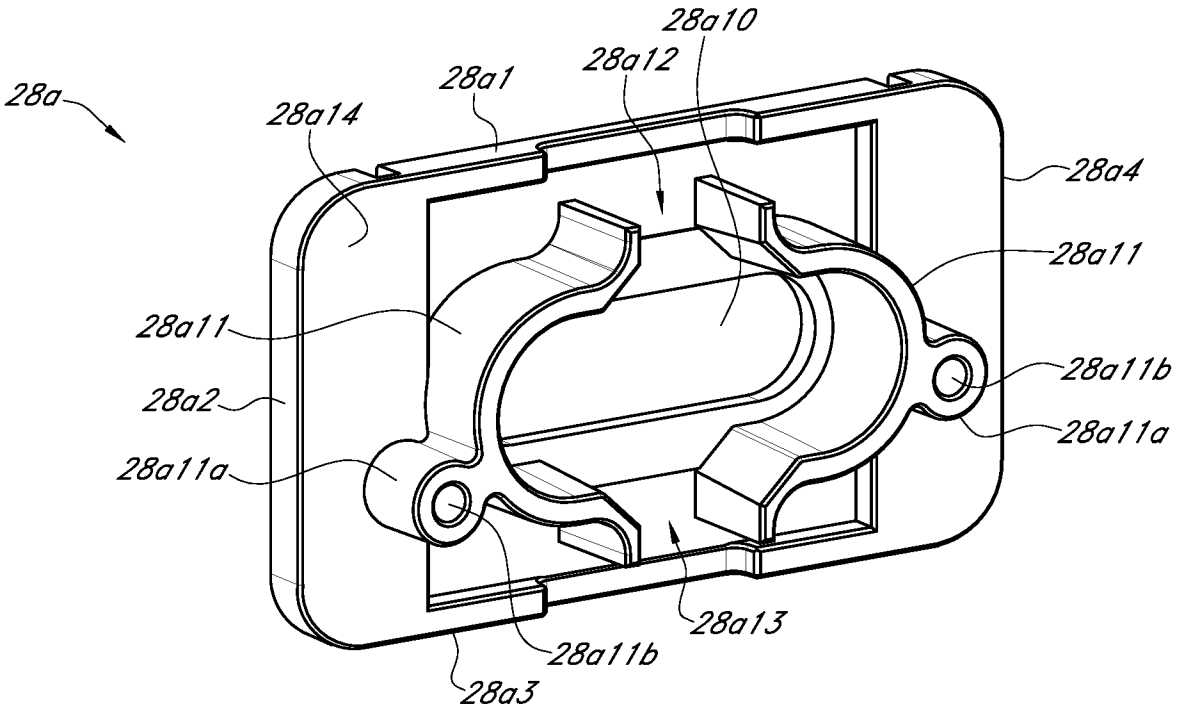
FIG. 17 is a rear perspective view of the interface receiver of FIG. 12.

Turning to FIG. 17, depicted therein is a rear perspective view of slab member 28*a*.

Figure 18:
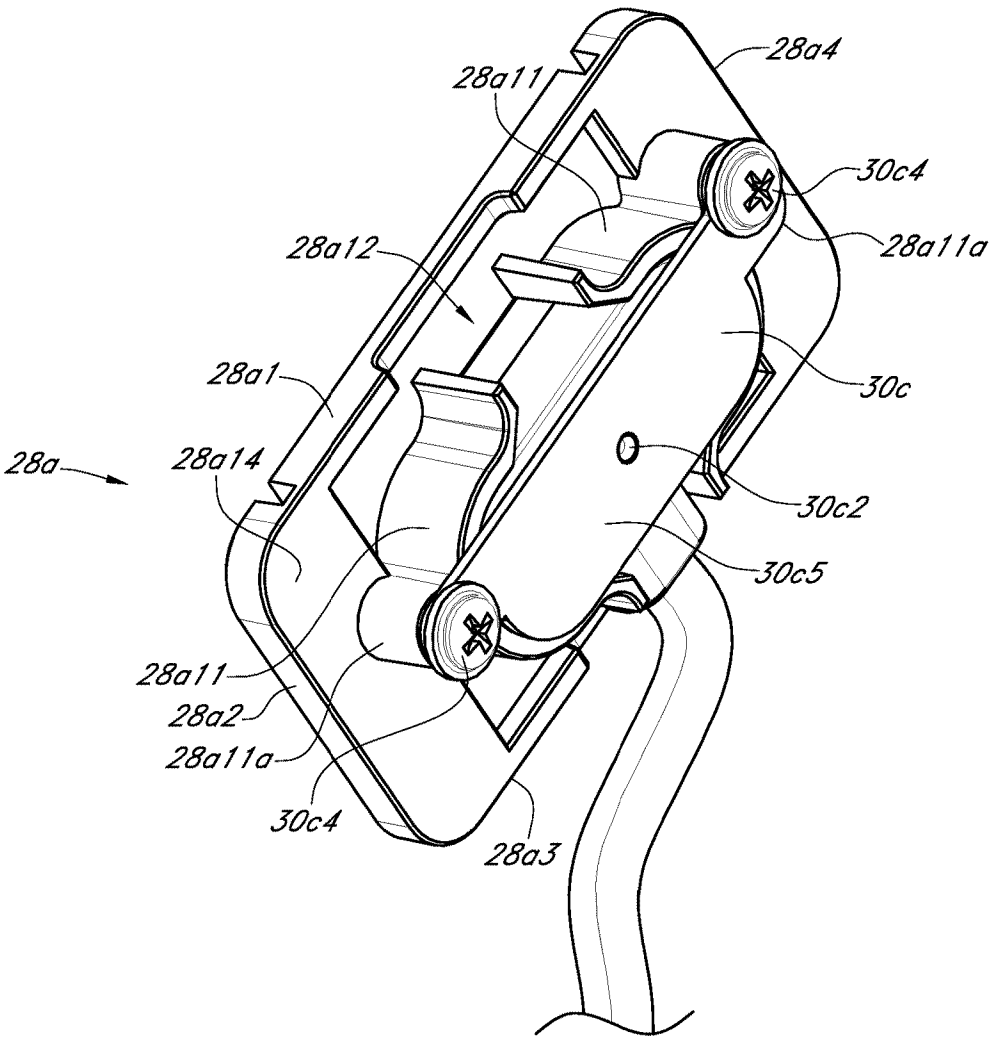
FIG. 18 is a rear perspective view of the interface receiver of FIG. 12 coupled with the interface of FIG. 13.

Turning to FIG. 18, depicted therein is a rear perspective view of slab member 28*a* coupled with interface assembly 30 such as with collar portion 28*a*11 of slab member 28*a* coupled therewith. Depicted implementation of plate member 30*c* is shown to include rear face 30*c*5.

Figure 19:
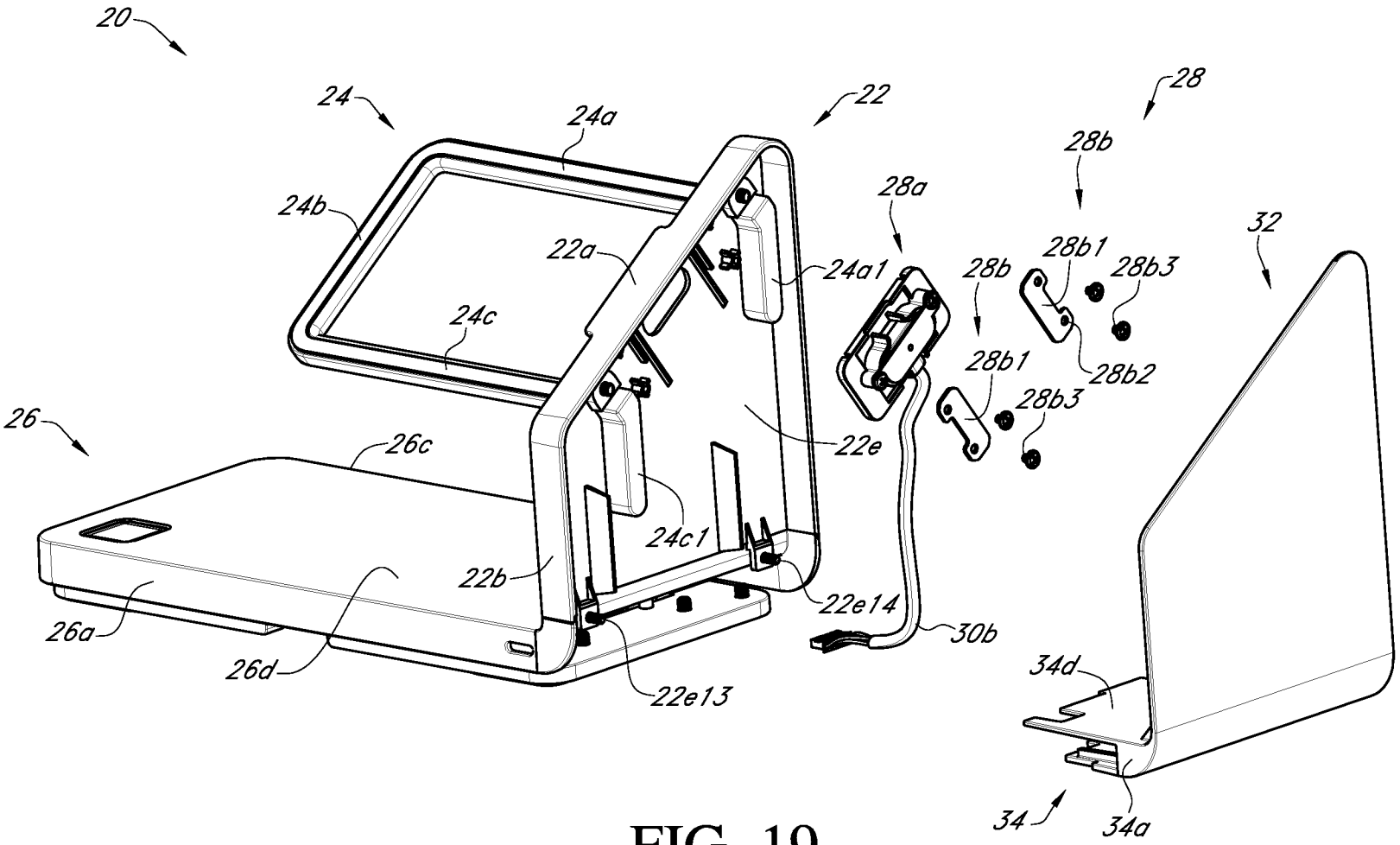
FIG. 19 is a top-rear perspective view of the stand assembly of FIG. 11.

Turning to FIG. 19, depicted therein is an exploded top-rear perspective view of stand assembly 20.

Figure 20:
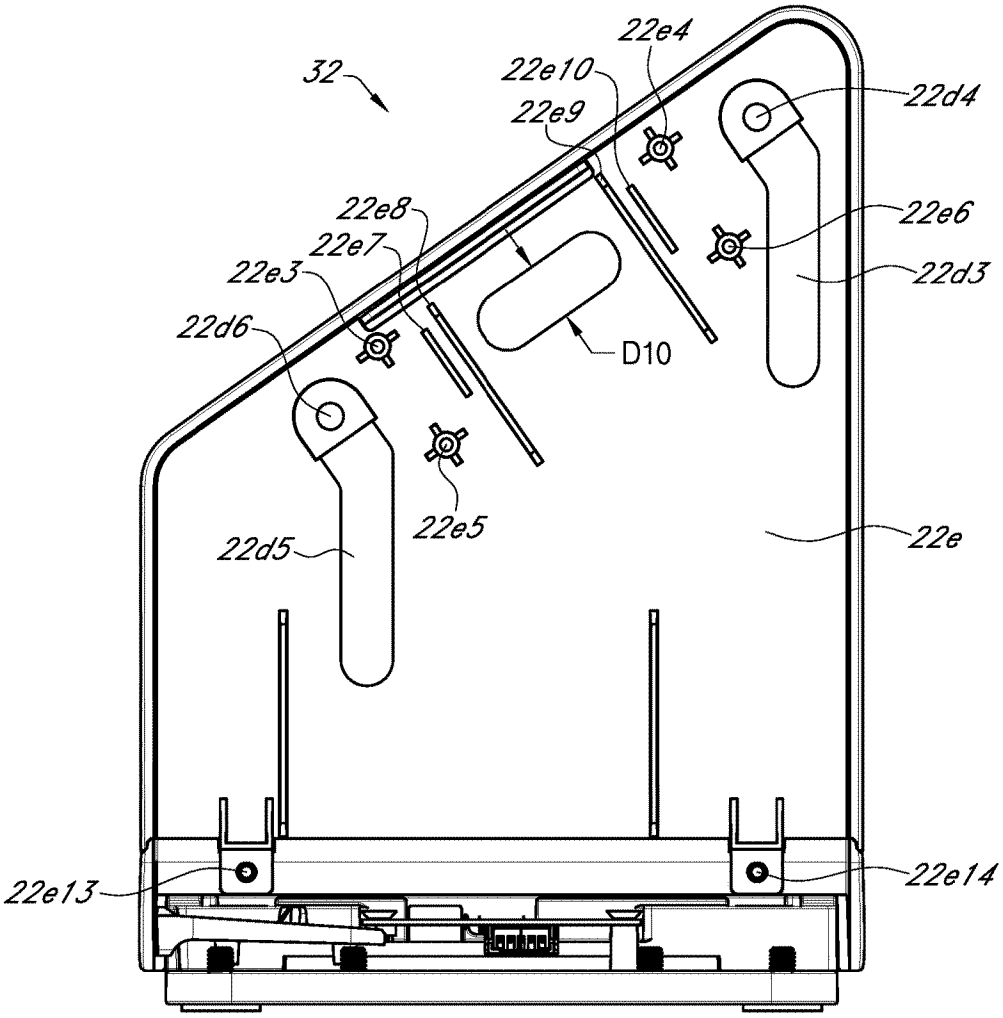
FIG. 20 is a rear elevational view of a portion of the stand assembly of FIG. 11.

Turning to FIG. 20, depicted therein is a rear elevational view of a portion of stand assembly 20.

Depicted implementation of wall portion 22 is shown to include interior face 22*e*. Depicted implementation of interior face 22*e* is shown to include aperture 22*e*3, aperture 22*e*4, aperture 22*e*5, aperture 22*e*6, elongated protrusion 22*e*7, elongated protrusion 22*e*8, elongated protrusion 22*e*9, elongated protrusion 22*e*10, fastener 22*e*13, fastener 22*e*14, and dimension D10.

Figure 21:
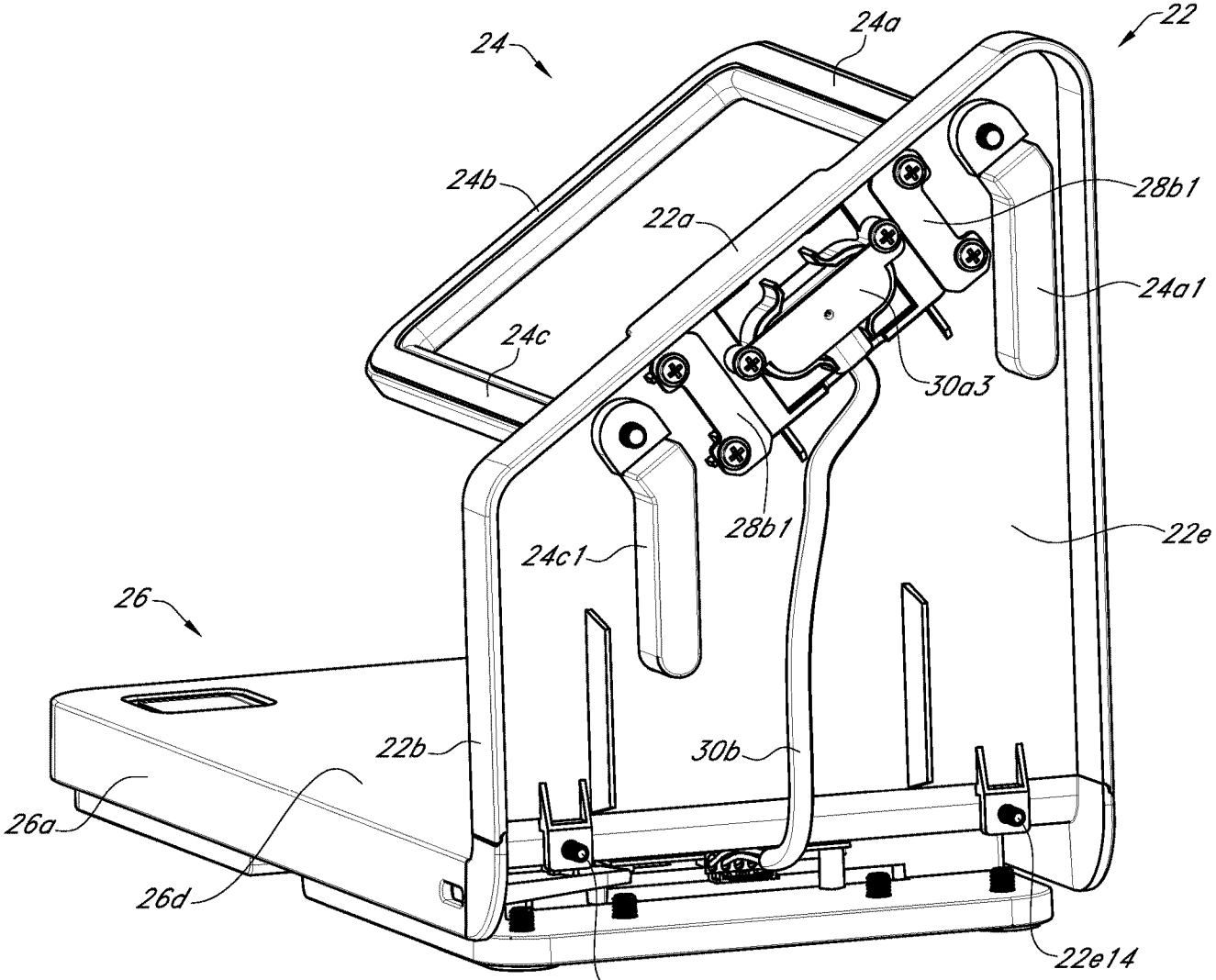
FIG. 21 is a rear perspective view of the portion of the stand assembly of FIG. 11 further including the interface of FIG. 13.

Turning to FIG. 21, depicted therein is a rear perspective view of a portion of the stand assembly of stand assembly 20.

Figure 22:
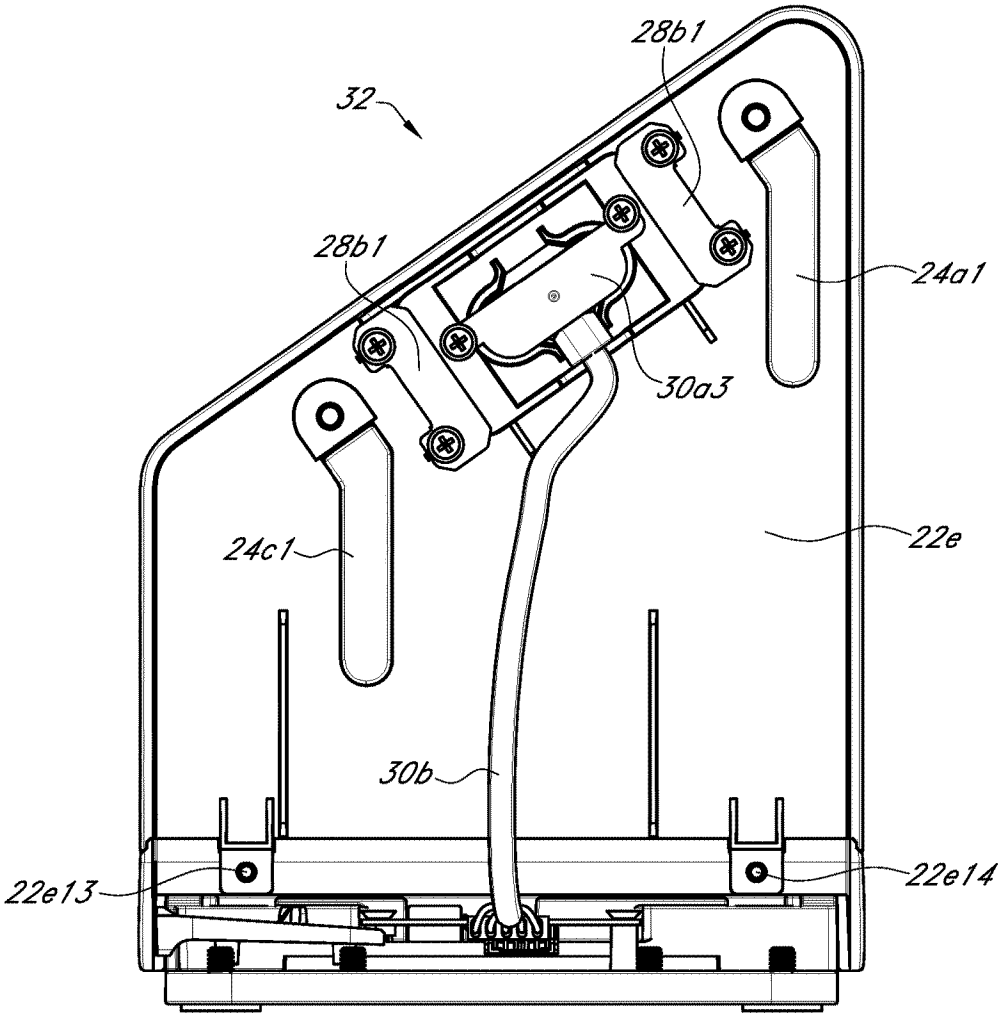
FIG. 22 is a rear elevational view of the portion of the stand assembly of FIG. 21.

Turning to FIG. 22, depicted therein is a rear elevational view of a portion of stand assembly 20.

Figure 23:
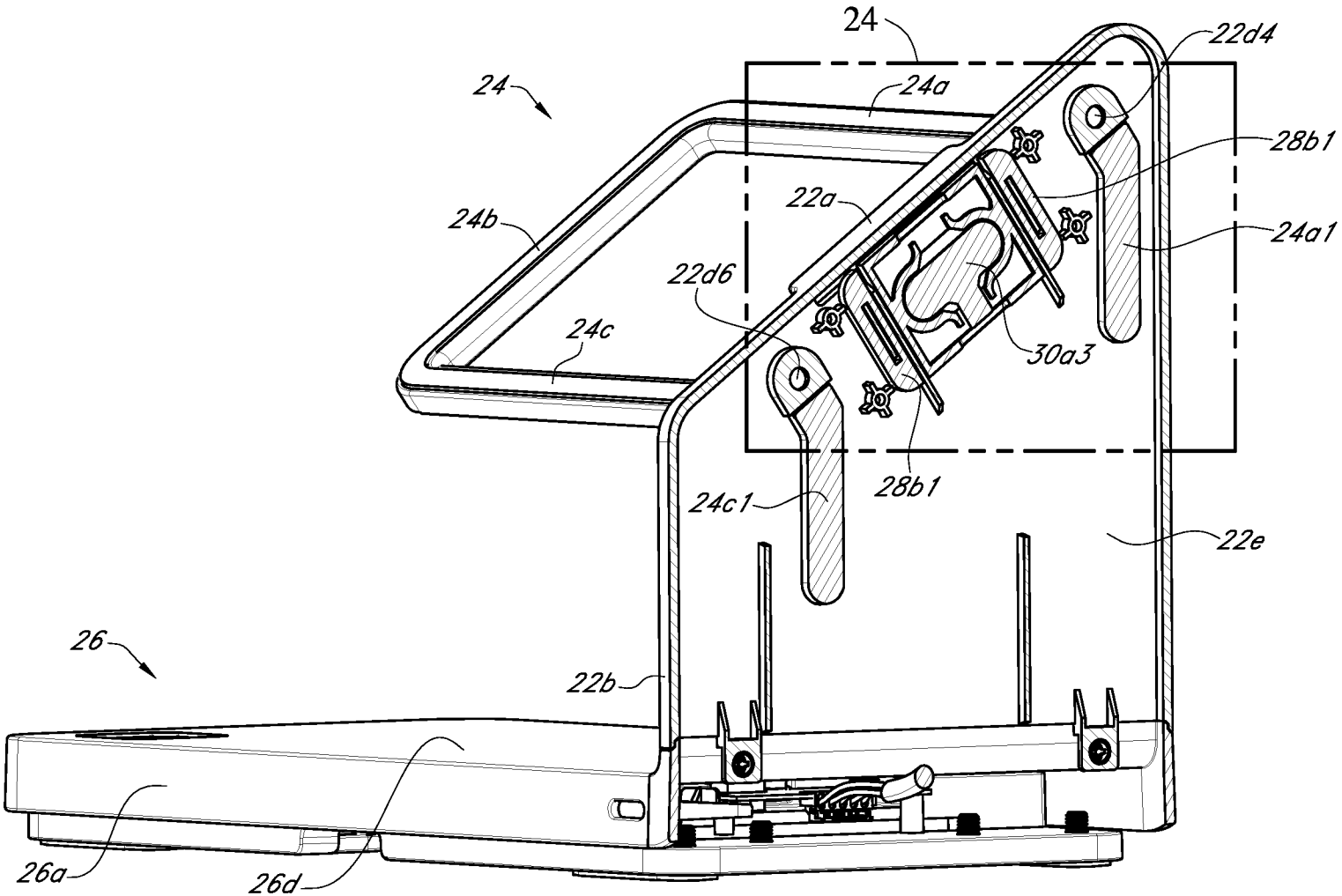
FIG. 23 is a cross-sectional rear perspective view of the portion of the stand assembly of FIG. 21.

Turning to FIG. 23, depicted therein is a cross-sectional rear perspective view of stand assembly 20.

Figure 24:
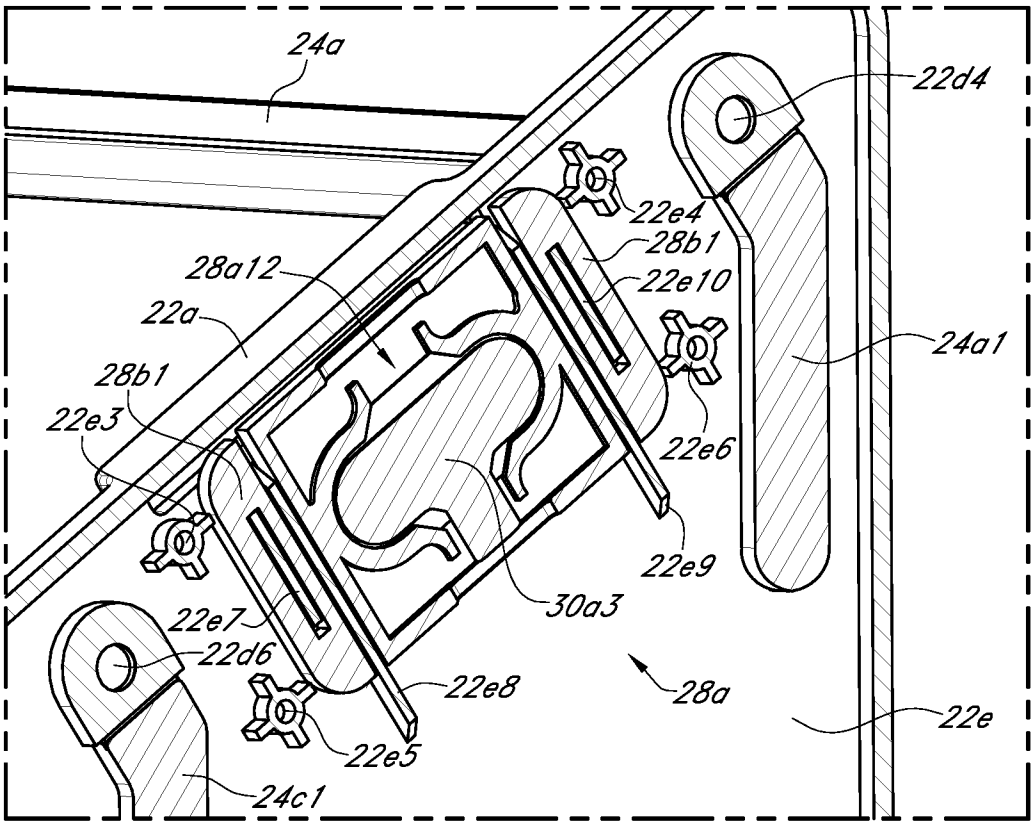
FIG. 24 is an enlarged cross-sectional rear perspective view of a portion of the stand assembly taken along the 24 dashed-line area of FIG. 23.

Turning to FIG. 24, depicted therein is an enlarged cross-sectional rear perspective view of a portion of stand assembly 20.

Figure 25:
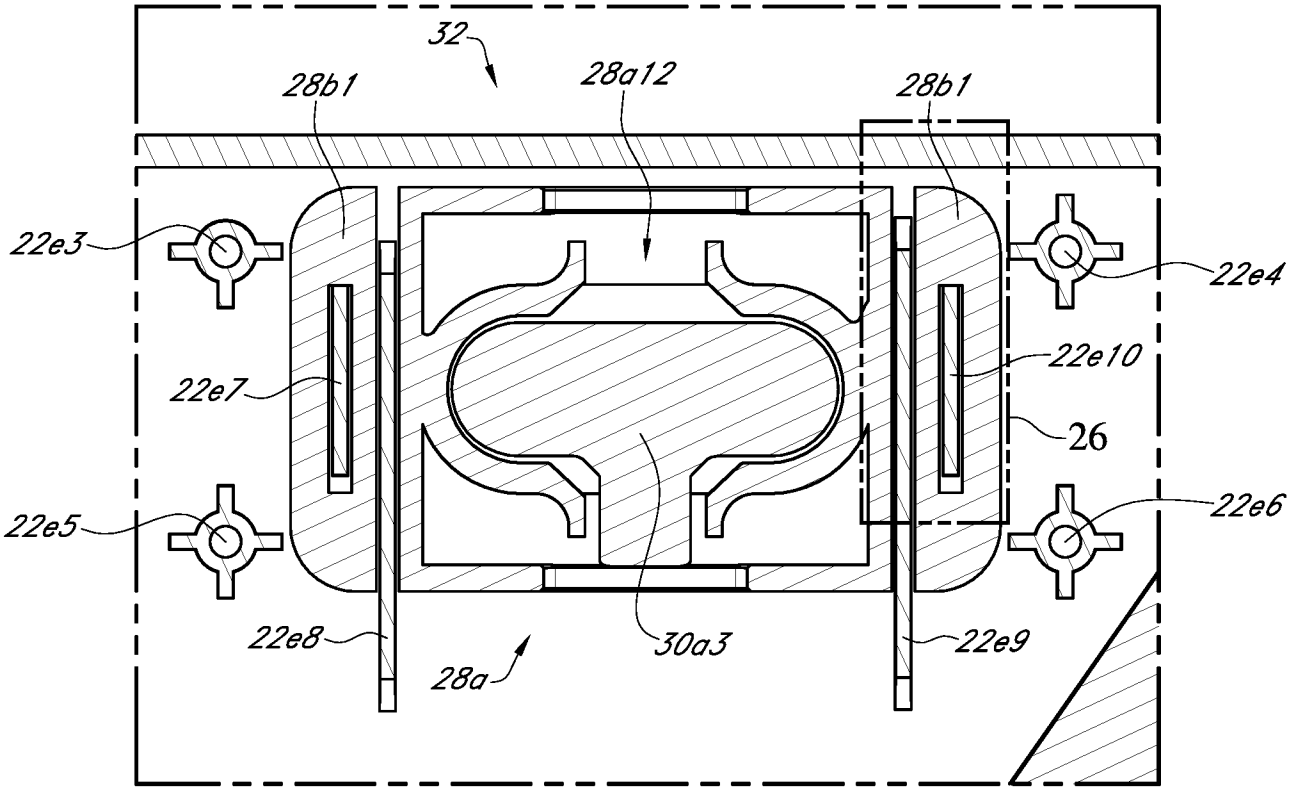
FIG. 25 is an enlarged cross-sectional rear elevational view of a portion of the stand assembly of FIG. 24 with the interface receiver of FIG. 12 in a first position.

Turning to FIG. 25, depicted therein is an enlarged cross-sectional rear elevational view of a portion of stand assembly 20 with slab member 28*a* in a first position. As depicted elongated protrusion 22*e*7, elongated protrusion 22*e*8, elongated protrusion 22*e*9, elongated protrusion 22*e*10 of wall portion 22 are slidably coupled with groove 28*a*6, groove 28*a*8, groove 28*a*7, groove 28*a*5 of slab member 28*a*, respectively to generally move in a direction perpendicular to a row of contacts (such as a row of electrical contact 30*a*2 shown in FIG. 13) from the first position to at least one other position to, for instance, accommodate variability of positioning of electrical contact 14*c*1 and electrical contact 14*c*2 by dimension D1 (shown in FIG. 9) depending upon particular manufacturer of accessory assembly 14.

Figure 26:
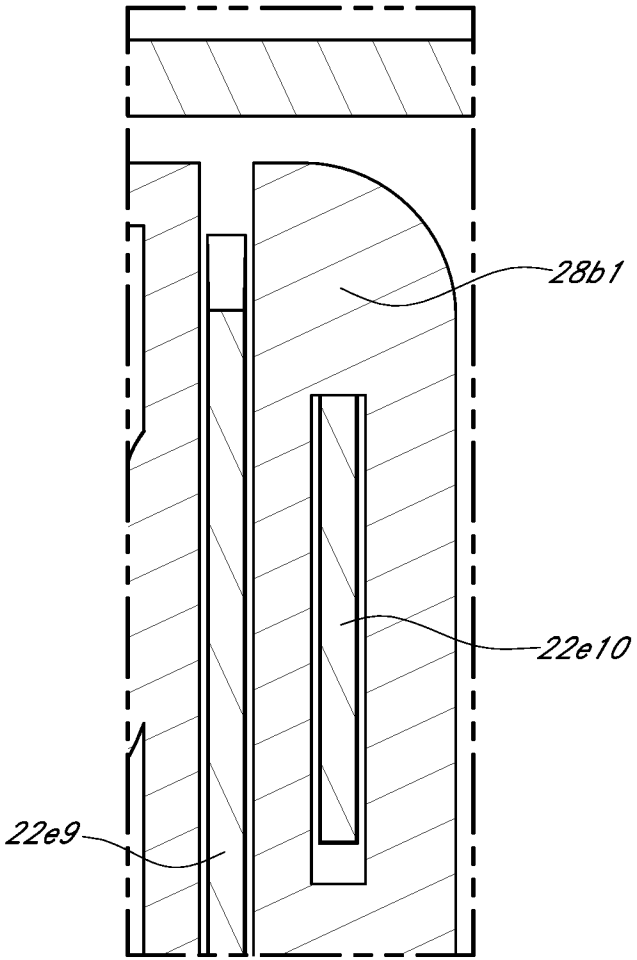
FIG. 26 is an enlarged cross-sectional rear elevational view of a portion of the stand assembly of FIG. 25 with the interface receiver of FIG. 12 in the first position.

Turning to FIG. 26, depicted therein is an enlarged cross-sectional rear elevational view of stand assembly 20 with slab member 28*a* in the first position.

Figure 27:
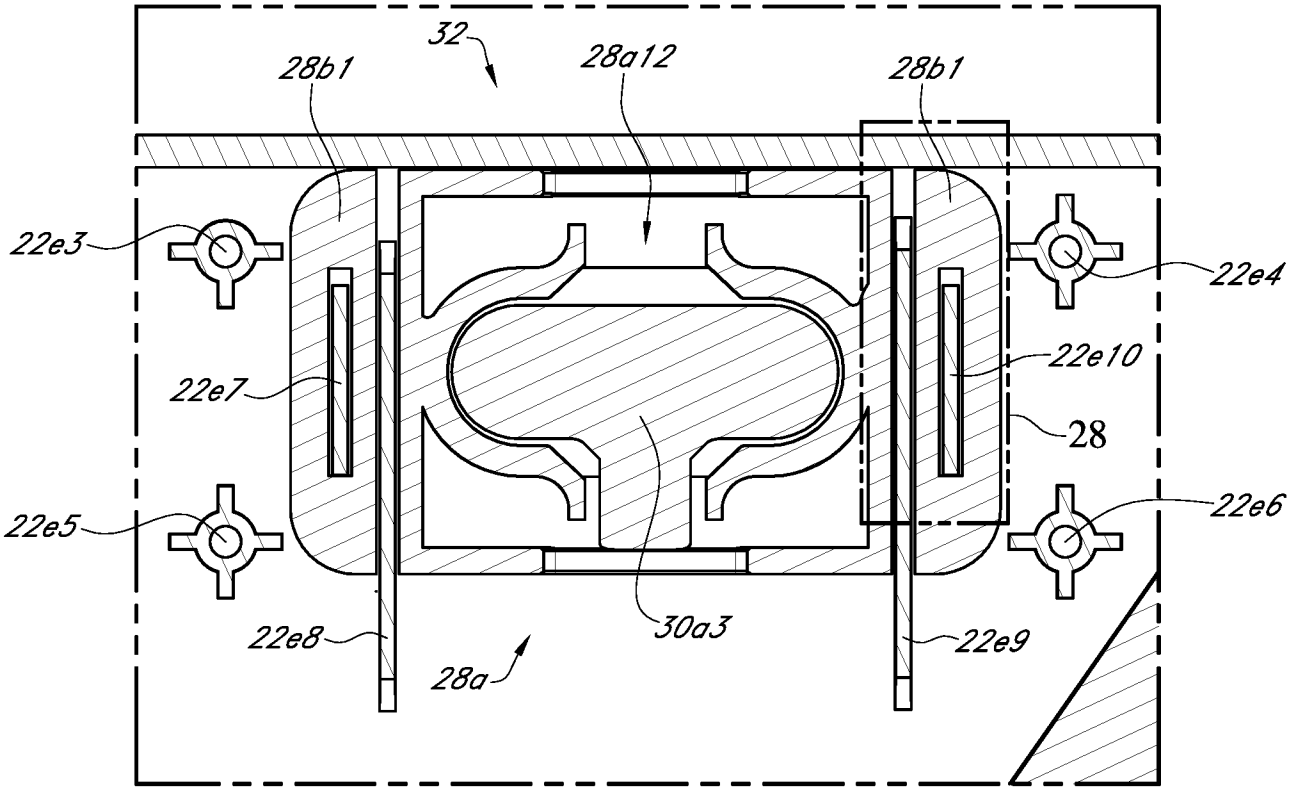
FIG. 27 is an enlarged cross-sectional rear elevational view of a portion of the stand assembly of FIG. 24 with the interface receiver of FIG. 12 in a second position.

Turning to FIG. 27, depicted therein is an enlarged cross-sectional rear elevational view of a portion of stand assembly 20 with slab member 28*a* in a second position.

Figure 28:
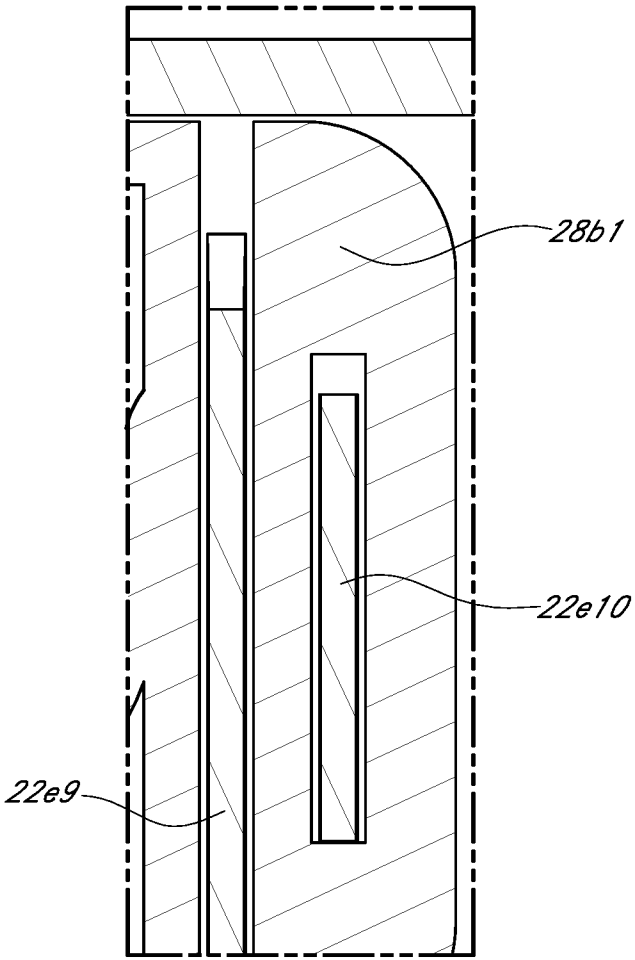
FIG. 28 is an enlarged cross-sectional rear elevational view of a portion of the stand assembly of FIG. 27 with the interface receiver of FIG. 12 in the second position.

Turning to FIG. 28, depicted therein is an enlarged cross-sectional rear elevational view of stand assembly 20 with slab member 28*a* in the second position.

Figure 29:
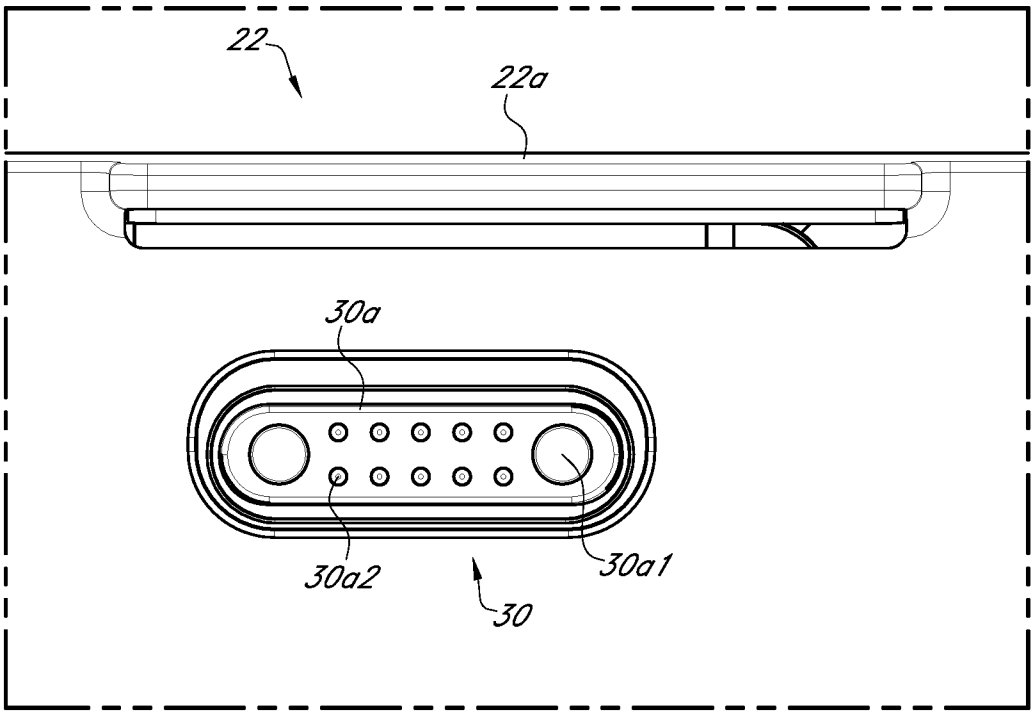
FIG. 29 is an enlarged front elevational view of a portion of the stand assembly of FIG. 24 with the interface of FIG. 13 in the first position of the interface receiver of FIG. 12.

Turning to FIG. 29, depicted therein is an enlarged front elevational view of a portion of stand assembly 20 with interface 30*a* in the first position of slab member 28*a*.

Figure 30:
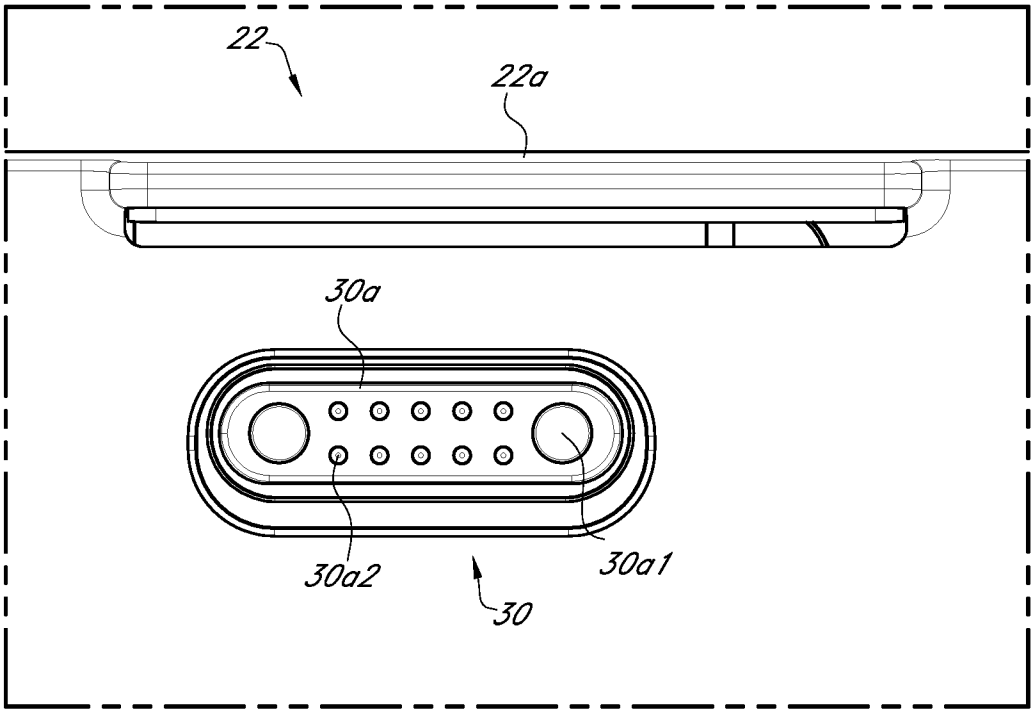
FIG. 30 is an enlarged front elevational view of a portion of the stand assembly of FIG. 24 with the interface of FIG. 13 in the second position of the interface receiver of FIG. 12.

Turning to FIG. 30, depicted therein is an enlarged front elevational view of a portion of stand assembly 20 with interface 30*a* in the second position of slab member 28*a*.

Figure 31:
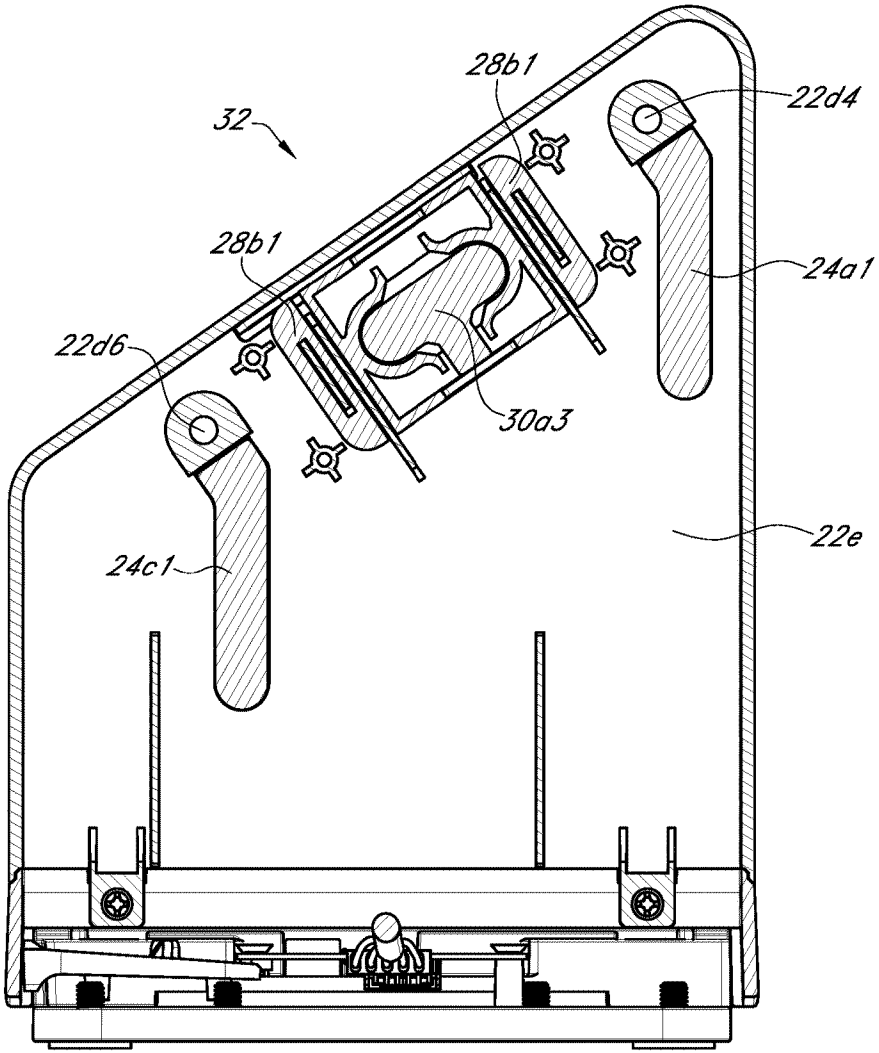
FIG. 31 is a rear elevational cross-sectional view of the portion of the stand assembly of FIG. 21.

Turning to FIG. 31, depicted therein is a rear elevational cross-sectional view of a portion of stand assembly 20.

Figure 32:
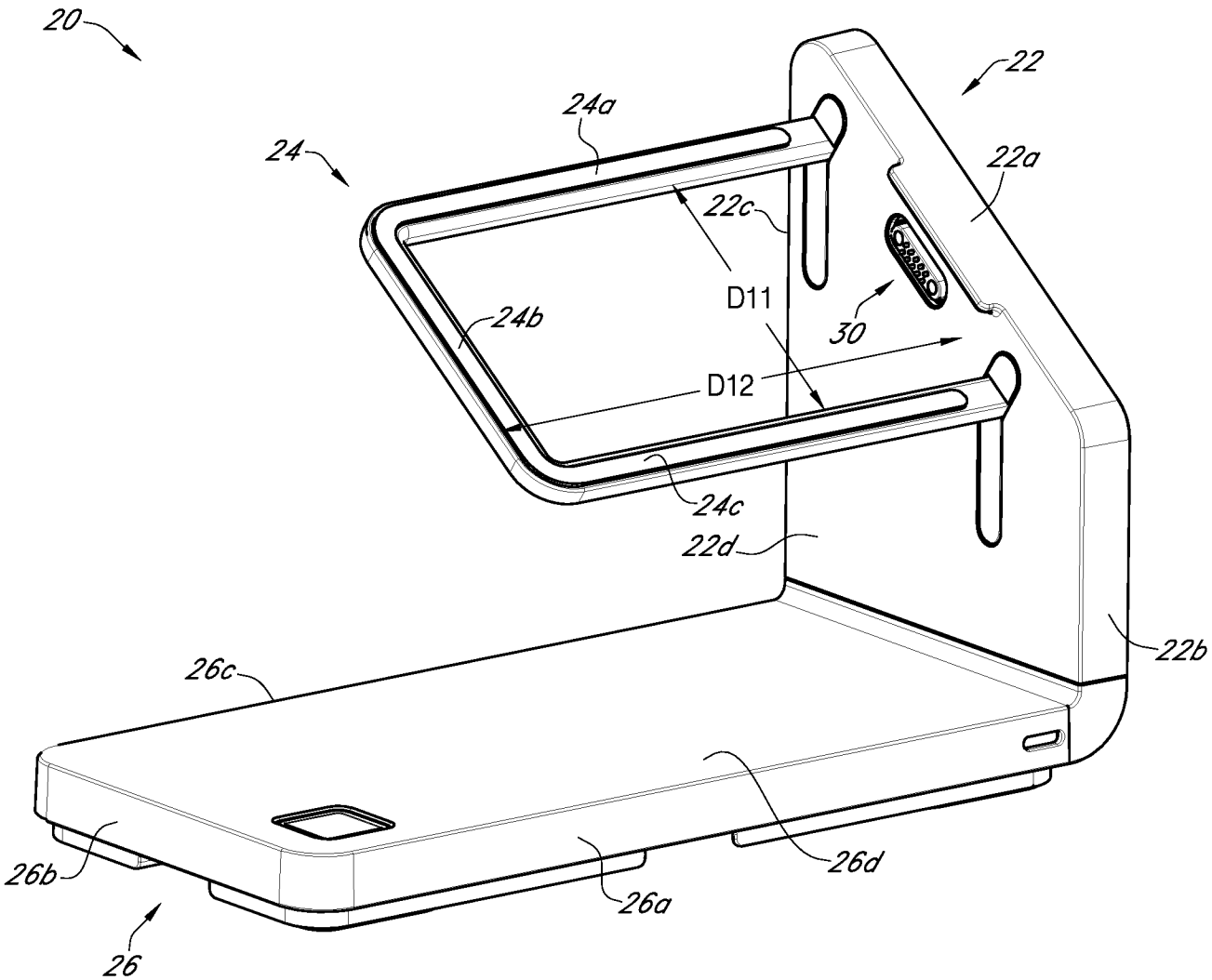
FIG. 32 is a right front top perspective view of the stand assembly of FIG. 11.

Turning to FIG. 32, depicted therein is a right front top perspective view of stand assembly 20 shown to include dimension D11 and dimension D12. As depicted elongated portion 24*a* is spaced from elongated portion 24*c* at least half the distance that side 26*c* is spaced from exterior face 26*d*. As depicted elongated portion 24*b* is spaced from exterior face 22*d* at least half the distance that end 26*b* is spaced from exterior face 22*d*.

Figure 33:
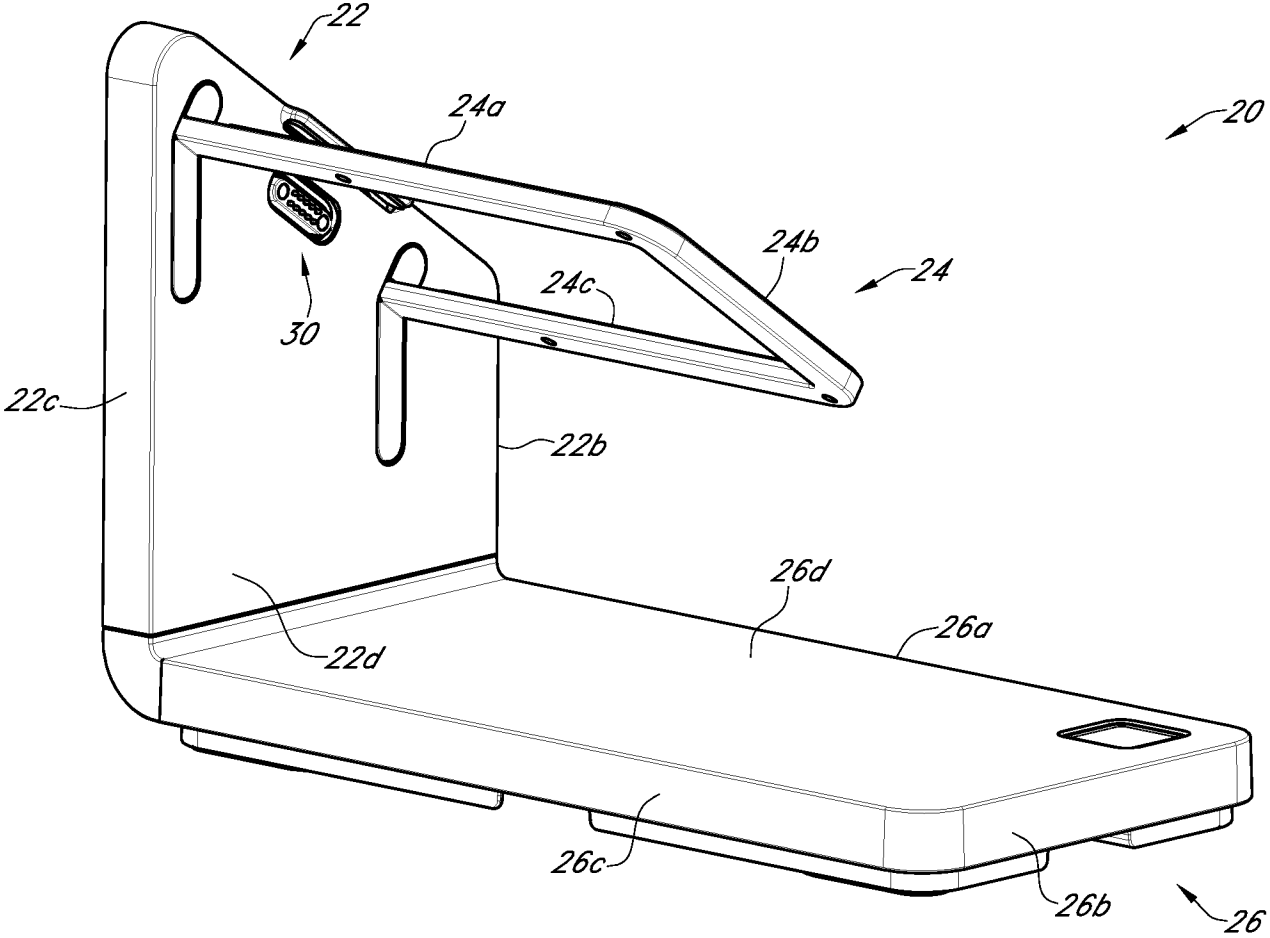
FIG. 33 is a left front top perspective view of the stand assembly of FIG. 11.

Turning to FIG. 33, depicted therein is a left front top perspective view of stand assembly 20.

Figure 34:
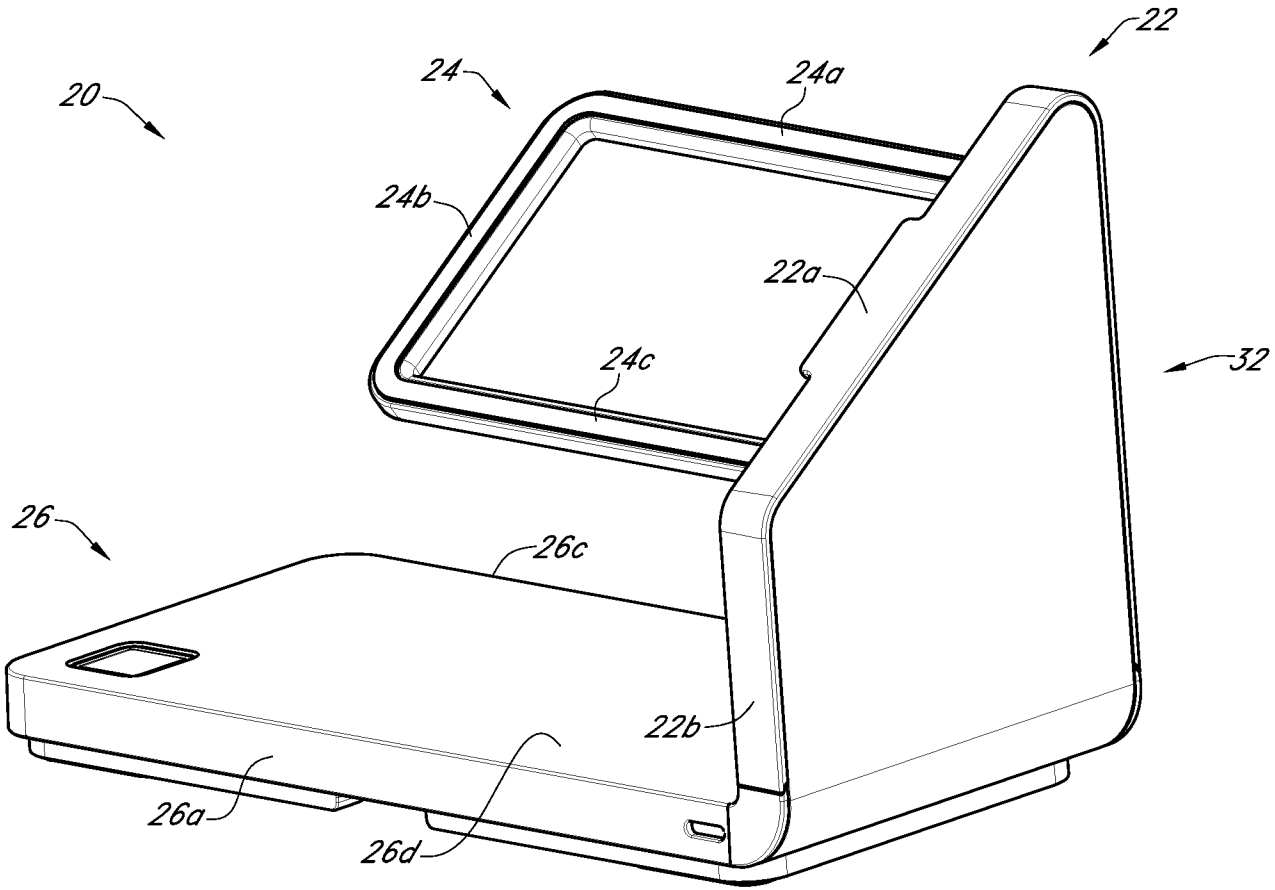
FIG. 34 is a right rear top perspective view of the stand assembly of FIG. 11.

Turning to FIG. 34, depicted therein is a right rear top perspective view of stand assembly 20.

Figure 35:
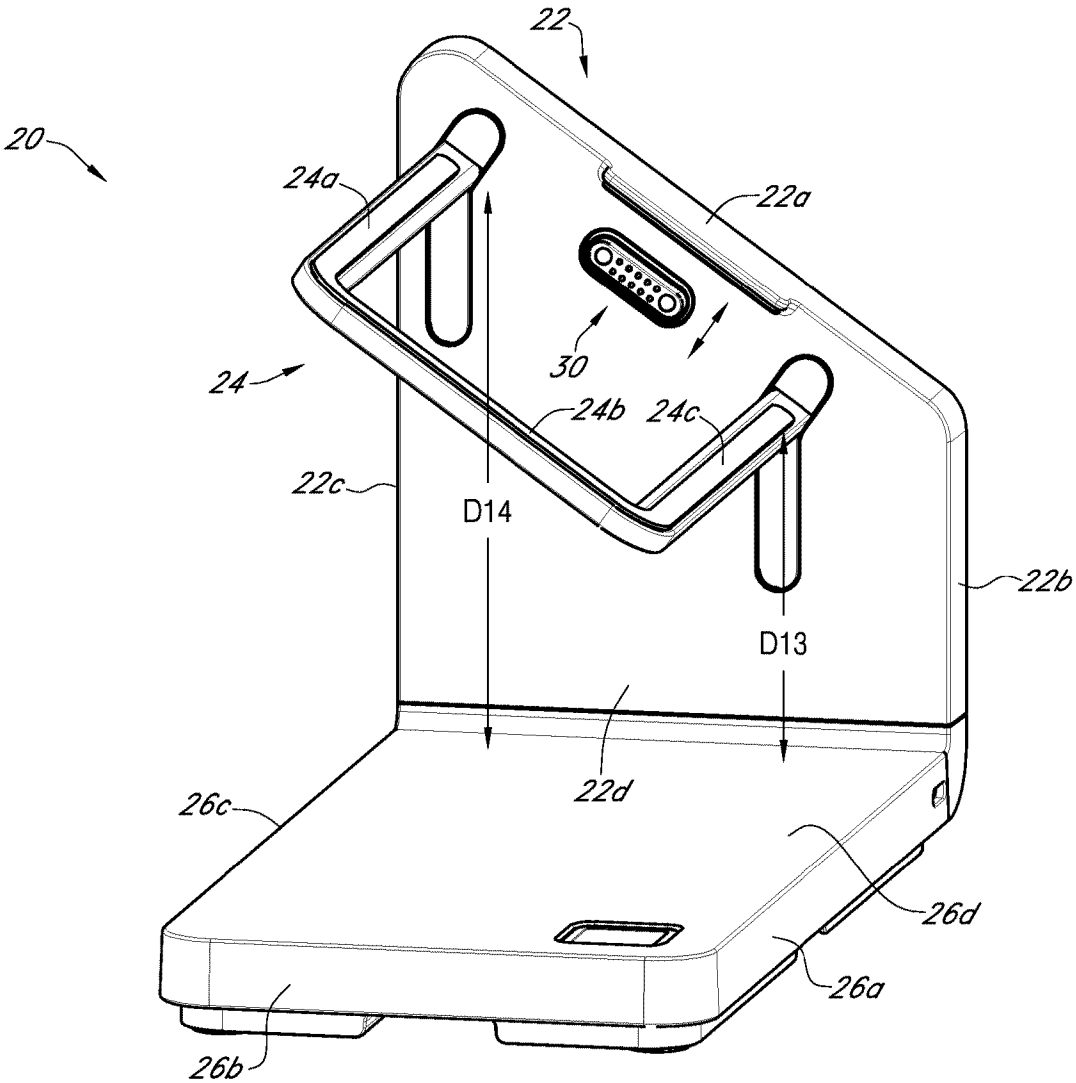
FIG. 35 is a right front top perspective view of the stand assembly of FIG. 11.

Turning to FIG. 35, depicted therein is a right front top perspective view of stand assembly 20 shown to include dimension D13 and dimension D14.

Figure 36:
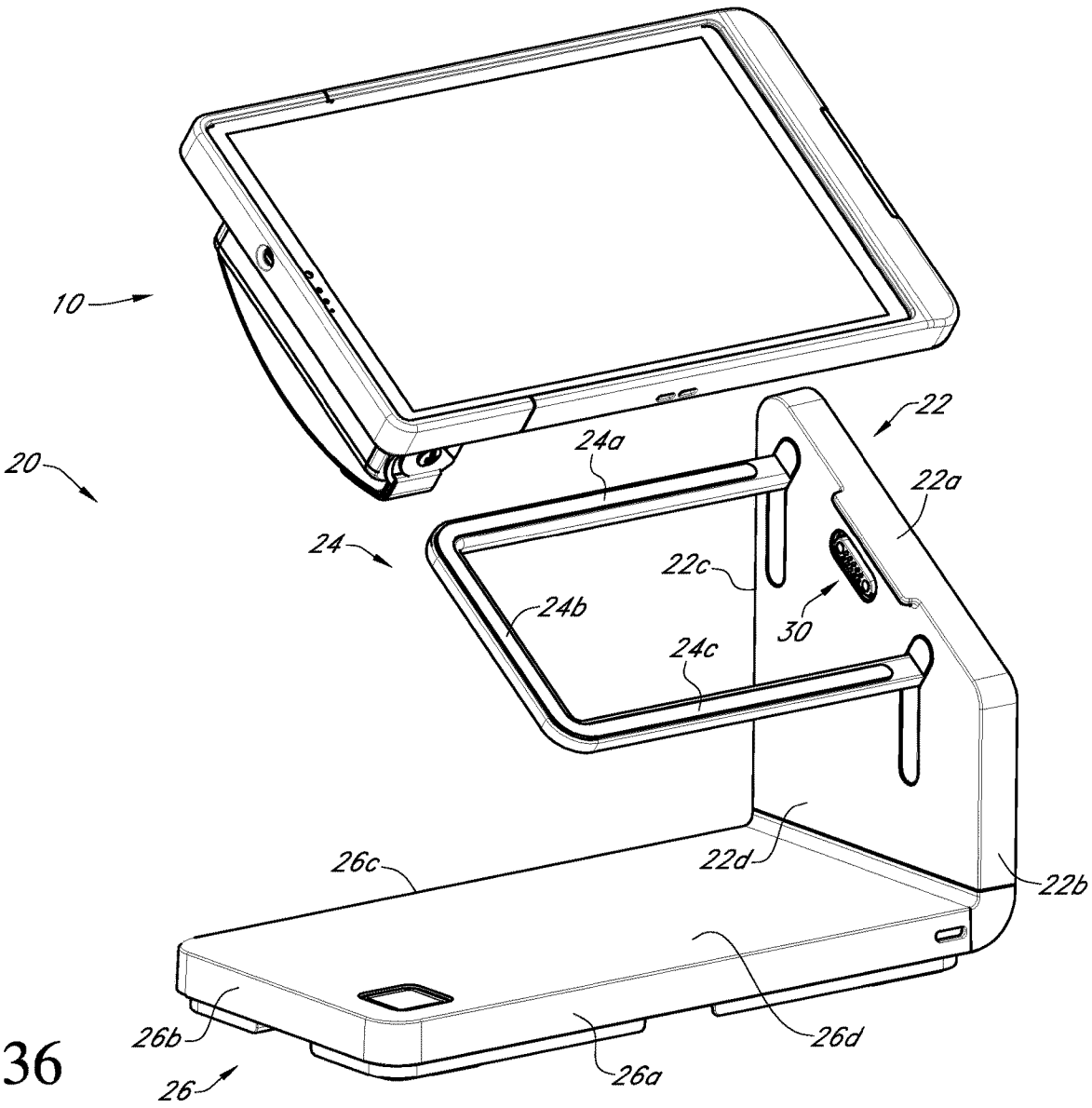
FIG. 36 is a right front top perspective view of the stand assembly of FIG. 11 uncoupled from the case assembly of FIG. 1.

Turning to FIG. 36, depicted therein is a right front top perspective view of combination assembly system 10 uncoupled from stand assembly 20.

Figure 37:
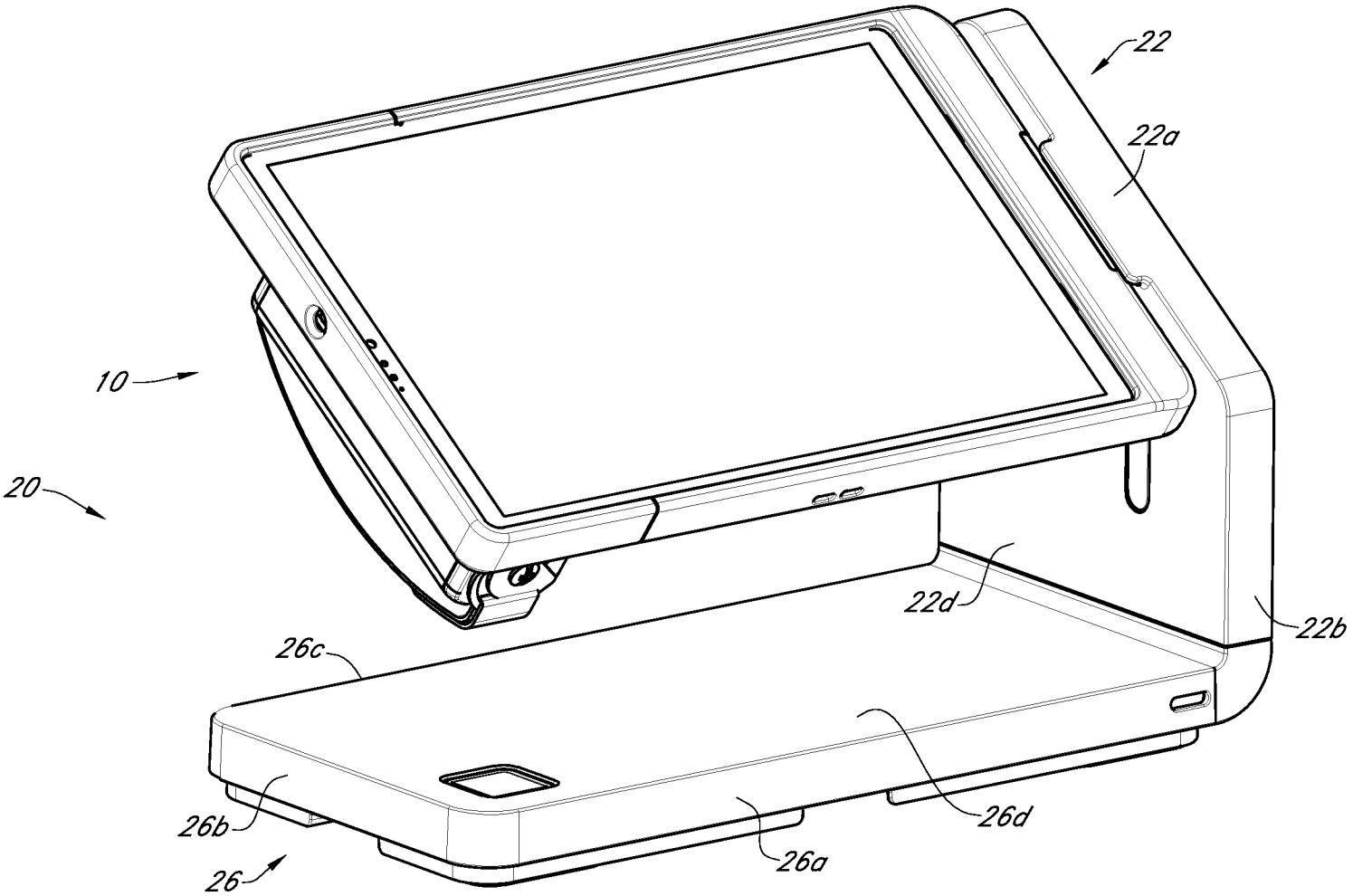
FIG. 37 is a right front top perspective view of the stand assembly of FIG. 11 coupled with the case assembly of FIG. 1.

Turning to FIG. 37, depicted therein is a right front top perspective view of stand assembly 20 coupled with combination assembly system 10.

Figure 38:
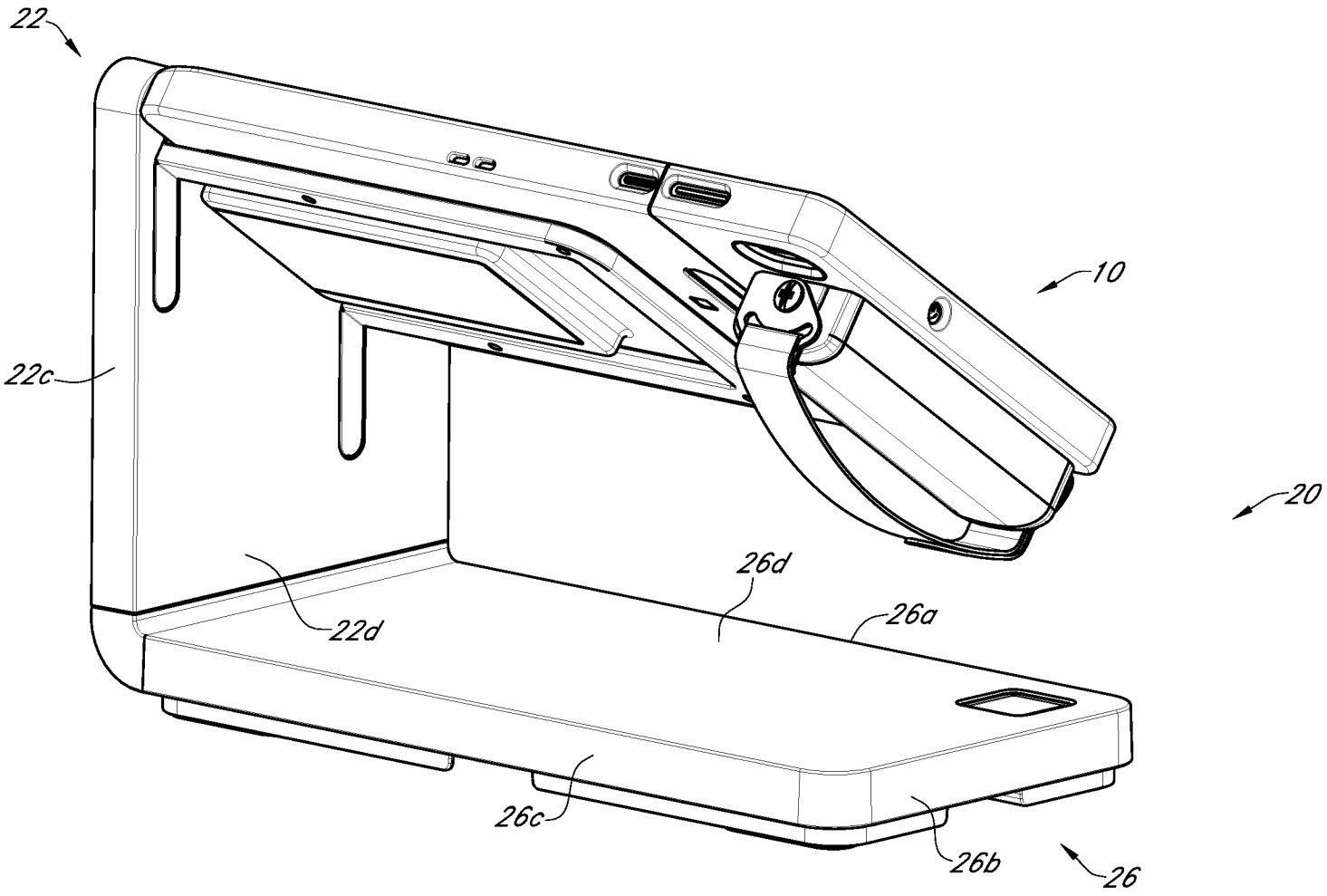
FIG. 38 is a right front top perspective view of the stand assembly of FIG. 11 coupled with the case assembly of FIG. 1.

Turning to FIG. 38, depicted therein is a right front top perspective view of stand assembly 20 coupled with combination assembly system 10.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., " a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sens-se one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A stand assembly system for a portable electronic device, the stand assembly comprising:

(I) a base having an exterior face;

(II) a wall portion including an exterior face, the wall portion coupled to the base, the exterior face of the wall portion extending perpendicular with respect to the exterior face of the base;

(III) a support assembly including a first elongated portion extending perpendicular with respect to the exterior face of the wall portion; and (IV) an interface including a plurality of electrical contacts, wherein the interface is movably coupled having at least a first position and a second position, wherein the support assembly further includes a first elongated protrusion extending perpendicularly from the first elongated portion and a second elongated protrusion extending perpendicularly from the second elongated portion, wherein the wall portion includes a first elongated aperture and a second elongated aperture, wherein the support assembly is couplable with the wall portion with the first elongated protrusion being at least partially coupled with the first elongated aperture and the second elongated protrusion being at least partially coupled with the second elongated aperture, wherein the first elongated protrusion is spaced a first distance from the exterior face of the base and the second elongated protrusion is spaced a second distance from the exterior face of the base, and wherein the first distance is greater than the second distance.

2. The system of claim 1 wherein the plurality of electrical contacts includes at least one pogo pin.

3. The system of claim 1 wherein the interface is movably coupled to the wall portion.

4. The system of claim 1 wherein the plurality of electrical contacts of the interface includes at least one row of electrical contacts positioned along a first direction, and wherein the interface is movably coupled to the wall portion to move in a second direction perpendicular to the first direction.

5. The system of claim 1 wherein the support assembly further includes a second elongated portion extending perpendicular with respect to the exterior face of the wall portion, wherein the base includes two sides with the exterior face of the base extending a first width therebetween, and wherein the first elongated portion and the second elongated portion of the support assembly are spaced from one another with a gap therebetween at least one half of the first width of the exterior face of the base.

6. The system of claim 1 wherein the support assembly further includes a third elongated portion extending perpendicular to and therebetween the first elongated portion and the second elongated portion, wherein the base includes an end with the exterior face of the base extending a first length between the end and the wall portion, and wherein the third elongated portion of the support assembly is spaced from the exterior face of the wall portion at least one half of the first length the exterior face of the base.

7. A stand assembly system for a portable electronic device, the stand assembly comprising:

(I) a base having an exterior face;

(II) a wall portion including an exterior face, the wall portion coupled to the base, the exterior face of the wall portion extending perpendicular with respect to the exterior face of the base;

(III) a support assembly including a first elongated portion extending perpendicular with respect to the exterior face of the wall portion; and (IV) an interface including a plurality of electrical contacts, wherein the interface is movably coupled having at least a first position and a second position, wherein the wall portion has a first side, a second side, and an end extending therebetween, wherein the end is perpendicularly oriented with the exterior face of the wall portion, wherein the end includes a protrusion extending over the exterior surface of the base when the wall portion is coupled with the base.

8. The system of claim 7 wherein the wall portion includes an aperture, wherein the interface is movably coupled to the wall portion, and wherein a portion of the interface protrudes through the aperture of the wall portion when the interface is movably coupled to the wall portion.

9. A stand assembly system for a portable electronic device, the stand assembly comprising:

(I) a base having an exterior face;

(II) a wall portion including an exterior face, the wall portion coupled to the base, the exterior face of the wall portion extending perpendicular with respect to the exterior face of the base;

(III) a support assembly including a first elongated portion extending perpendicular with respect to the exterior face of the wall portion;

(IV) an interface including a plurality of electrical contacts, wherein the interface is movably coupled having at least a first position and a second position; and (V) a coupler assembly, wherein the coupler assembly includes a slab member with an aperture, wherein the coupler assembly is couplable with the interface, wherein the coupler assembly is couplable to the wall portion, and wherein at least a portion of the interface protrudes through the aperture of the slab member of the coupler assembly when the interface is coupled to the coupler assembly and the coupler assembly is coupled to the wall portion.

10. The system of claim 9 wherein the coupler assembly includes at least one collar portion positioned adjacent to the aperture of the coupler assembly, and wherein the interface is coupled with the at least one collar portion when the interface is coupled with the coupler assembly.

11. The system of claim 9 wherein the wall portion includes at least one elongated protrusion, wherein the slab member of the coupler assembly includes at least one groove, and wherein the at least one groove of the slab member is slidably coupled with the at least one elongated protrusion of the wall portion when the coupler assembly is coupled with the wall portion.

12. The system of claim 9 wherein the coupler assembly includes at least one plate member, and wherein the slab member of the coupler assembly is positioned between the at least one plate member and the wall portion when the coupler assembly is coupled to the wall portion.

13. The system of claim 9 further including electrical cabling, wherein the electrical cabling is electrically coupled with the interface.

14. A stand assembly system for a portable electronic device, the stand assembly comprising:

(I) a base having an exterior face;

(II) a wall portion including an exterior face and an aperture through the exterior face, the wall portion coupled to the base, the exterior face of the wall portion extending perpendicular with respect to the exterior face of the base;

(III) a support assembly including a first elongated portion extending perpendicular with respect to the wall portion; and (IV) an interface including a plurality of electrical contacts, wherein the interface is movably coupled to the wall portion, the interface being accessible through the aperture of the wall portion; and (V) a coupler assembly, wherein the coupler assembly includes a slab member with an aperture, wherein the coupler assembly is couplable with the interface, wherein the coupler assembly is couplable to the wall portion, wherein at least a portion of the interface protrudes through the aperture of the slab member of the coupler assembly when the interface is coupled to the coupler assembly and the coupler assembly is coupled to the wall portion, wherein the coupler assembly includes at least one plate member, and wherein the slab member of the coupler assembly is positioned between the at least one plate member and the wall portion when the coupler assembly is coupled to the wall portion.

15. The system of claim 14 wherein the plurality of electrical contacts of the interface includes at least one row of electrical contacts positioned along a first direction, and wherein the interface is movably coupled to the wall portion to move in a second direction perpendicular to the first direction.

16. A stand assembly system for a portable electronic device, the stand assembly comprising:

(I) a base having an exterior face;

(II) a wall portion including an exterior face and an aperture through the exterior face, the wall portion coupled to the base, the exterior face of the wall portion extending perpendicular with respect to the exterior face of the base;

(III) a support assembly including a first elongated portion extending perpendicular with respect to the wall portion; and (IV) an interface including a plurality of electrical contacts, wherein the interface is movably coupled to the wall portion, wherein the interface is accessible through the aperture of the wall portion when the interface is movably coupled to the wall portion, wherein the plurality of electrical contacts of the interface includes at least one row of electrical contacts positioned along a first direction, wherein the interface is movably coupled to the wall portion to move in a second direction perpendicular to the first direction; and (V) a coupler assembly, wherein the coupler assembly includes a slab member with an aperture, wherein the coupler assembly is couplable with the interface, wherein the coupler assembly is couplable to the wall portion, and wherein at least a portion of the interface protrudes through the aperture of the slab member of the coupler assembly when the interface is coupled to the coupler assembly and the coupler assembly is coupled to the wall portion.

17. The system of claim 16 wherein the wall portion includes at least one elongated protrusion, wherein the slab member of the coupler assembly includes at least one groove, and wherein the at least one groove of the slab member is slidably coupled with the at least one elongated protrusion o the wall portion when the coupler assembly is coupled with the wall portion.

* * * * *